US010159905B2

(12) United States Patent
Bagley

(10) Patent No.: US 10,159,905 B2
(45) Date of Patent: Dec. 25, 2018

(54) CONSTRUCTION TOY SET OF CONNECTABLE AND POSITIONABLE ELEMENTS

(71) Applicant: Gracewood Management, Inc., West Valley City, UT (US)

(72) Inventor: Jim Matthews Bagley, West Valley City, UT (US)

(73) Assignee: Gracewood Management, Inc., West Valley City, UT (US)

( * ) Notice: Subject to any disclaimer, the term of this patent is extended or adjusted under 35 U.S.C. 154(b) by 34 days.

(21) Appl. No.: 15/254,221

(22) Filed: Sep. 1, 2016

(65) Prior Publication Data

US 2018/0056207 A1 Mar. 1, 2018

(51) Int. Cl.

| | |
|---|---|
| ***A63H 33/04*** | (2006.01) |
| ***A63H 33/06*** | (2006.01) |
| ***A63H 33/08*** | (2006.01) |
| ***A63H 33/10*** | (2006.01) |

(52) U.S. Cl.

CPC ..... *A63H 33/062* (2013.01); *A63H 33/084* (2013.01); *A63H 33/086* (2013.01); *A63H 33/088* (2013.01); *A63H 33/101* (2013.01)

(58) Field of Classification Search

None

See application file for complete search history.

(56) References Cited

U.S. PATENT DOCUMENTS

| | | | | | |
|---|---|---|---|---|---|
| 2,406,759 | A | * | 9/1946 | Glukes | A63H 33/065 446/127 |
| 2,786,301 | A | * | 3/1957 | Torricelli | A63H 33/084 446/115 |
| D214,745 | S | * | 7/1969 | Walker | 446/127 |
| 3,487,579 | A | | 1/1970 | Brettingen | |
| 3,669,709 | A | | 10/1972 | Schmidt | |
| 3,979,855 | A | * | 9/1976 | Schmidt | A63H 33/062 446/112 |
| 3,991,511 | A | * | 11/1976 | McAllister | A63H 33/06 428/192 |
| 4,055,019 | A | | 10/1977 | Harvey | |
| D259,762 | S | * | 7/1981 | Sabin | D21/505 |
| 4,361,979 | A | | 12/1982 | Petersson | |

(Continued)

FOREIGN PATENT DOCUMENTS

| | | | |
|---|---|---|---|
| CA | 1304578 | A | 7/1992 |
| CA | 2160181 | A | 4/1997 |

(Continued)

*Primary Examiner* — John E Simms, Jr.
*Assistant Examiner* — Urszula M Cegielnik
(74) *Attorney, Agent, or Firm* — J. David Nelson

(57) ABSTRACT

A construction toy set with multiple construction elements, the construction elements having a generally wafer shaped element body with one or more internal receiver passages extending through the element body, the receiver passages having one or more receiver tracks extending laterally across the receiver passage, the element body having one or more element keys protruding laterally from the element body, element key dimensioning providing for insertion of an element key of a first construction element in a receiver track of a second construction element and for slidable mating of the element key of the first construction element with the receiver track of the second construction element.

19 Claims, 16 Drawing Sheets

(56) References Cited

U.S. PATENT DOCUMENTS 4,556,394 A * 12/1985 Chen ..... A63H 23/005 446/114
4,579,538 A 4/1986 Bass et al.
D285,463 S * 9/1986 Davis ..... D21/502
4,731,041 A * 3/1988 Ziegler ..... A63H 33/065 446/102
4,764,143 A * 8/1988 Gat ..... A63H 33/105 446/102
4,764,144 A 8/1988 Lyman
4,789,370 A * 12/1988 Ellefson ..... A63H 33/062 446/113
4,792,319 A * 12/1988 Svagerko ..... A63H 33/08 446/104
4,804,350 A * 2/1989 Chen ..... A63H 33/04 446/112
4,823,532 A * 4/1989 Westerburgen ..... A63H 33/08 446/122
D304,218 S * 10/1989 Klitsner ..... D21/496
4,902,259 A 2/1990 Ziegler
4,919,635 A * 4/1990 Bertrand ..... A63H 33/086 446/124
D307,774 S * 5/1990 Bertrand ..... D21/500
5,022,885 A * 6/1991 Lyman ..... A63H 33/08 446/117
5,094,643 A * 3/1992 Bolli ..... A63H 33/04 403/348
5,104,345 A * 4/1992 Lyman ..... A63H 33/10 446/101
5,112,156 A 5/1992 Boyer
5,209,693 A * 5/1993 Lyman ..... A63H 33/042 403/157
5,259,803 A * 11/1993 Lyman ..... A63H 31/00 446/103
5,304,086 A * 4/1994 Bolli ..... A63H 33/042 446/104
5,322,467 A 6/1994 Barzani
D352,743 S * 11/1994 Kushner ..... D21/500
5,460,561 A * 10/1995 Dahlgren ..... A63H 33/04 446/103
5,482,491 A * 1/1996 Kichijyo ..... A63H 33/08 446/112
5,518,434 A 5/1996 Ziegler
D371,401 S * 7/1996 Nielsen ..... D21/496
5,582,488 A * 12/1996 Dudley ..... A63H 33/042 16/367
5,653,621 A * 8/1997 Yao ..... A63H 33/082 446/127
5,704,186 A 1/1998 Alcalay et al.
5,826,394 A * 10/1998 Barton, Jr. ..... A63H 33/044 52/592.1
5,871,384 A * 2/1999 Kichijo ..... A63H 33/062 446/112
D414,276 S * 9/1999 Bruno ..... D21/488
5,951,356 A * 9/1999 Cyrus ..... A63H 18/00 446/110
5,964,635 A * 10/1999 Krog ..... A63H 33/101 446/116
6,109,997 A * 8/2000 Hatting ..... A63H 33/062 446/103
6,142,848 A * 11/2000 Madner ..... A63H 33/04 446/107
6,186,856 B1 * 2/2001 Chen ..... A63H 33/04 446/117
6,223,921 B1 * 5/2001 Huang ..... A45C 11/24 132/295
6,315,628 B1 * 11/2001 Quercetti ..... A63H 33/04 446/103
6,422,909 B2 7/2002 Clever et al.
6,561,866 B1 * 5/2003 Lee ..... A63H 33/042 446/103
6,592,421 B1 7/2003 Clever
6,669,526 B2 * 12/2003 Manville ..... A63H 33/101 446/100
6,796,443 B2 * 9/2004 Lippman ..... A47F 5/05 211/131.1
6,899,588 B1 * 5/2005 Clever ..... A63H 33/084 446/120
7,198,537 B1 4/2007 Clever et al.
8,382,548 B2 2/2013 Maggiore et al.
8,668,542 B2 * 3/2014 Bruzgul ..... A63H 23/10 114/264
9,821,243 B2 * 11/2017 Shestak ..... A63H 33/042
2002/0086605 A1 * 7/2002 Cheung ..... A63H 33/062 446/124
2002/0187720 A1 * 12/2002 Engle ..... A63H 33/10 446/85
2003/0082986 A1 * 5/2003 Wiens ..... A63H 33/062 446/120
2003/0129919 A1 * 7/2003 Glickman ..... A63H 33/062 446/126
2004/0224601 A1 * 11/2004 Bagley ..... A63H 33/062 446/85
2005/0287906 A1 * 12/2005 He ..... A63H 33/082 446/109
2006/0172656 A1 * 8/2006 Hussa-Lietz ..... A63H 33/04 446/124
2007/0060012 A1 * 3/2007 Comfort ..... A63F 7/3622 446/168
2007/0264901 A1 * 11/2007 Sisamos ..... A63H 33/062 446/90
2008/0003917 A1 * 1/2008 Norman ..... A63F 9/08 446/97
2009/0004946 A1 * 1/2009 Sinisi ..... A63H 33/082 446/124
2010/0130094 A1 5/2010 Michalk et al.
2010/0210173 A1 8/2010 Maggiore et al.
2010/0330867 A1 * 12/2010 Fogel ..... A63H 33/062 446/124
2011/0081824 A1 * 4/2011 Heston ..... A63H 33/044 446/86
2012/0270463 A1 * 10/2012 Ziegler ..... A63H 33/08 446/85
2013/0078034 A1 3/2013 Kapelonis
2013/0102220 A1 4/2013 Wang et al.
2013/0115848 A1 * 5/2013 Silverglate ..... A63H 33/04 446/124
2014/0017970 A1 * 1/2014 Comfort ..... A63H 18/02 446/168
2015/0099417 A1 * 4/2015 Draghicescu ..... A63H 33/08 446/108
2015/0260206 A1 * 9/2015 Acerra ..... A63H 33/084 403/364
2016/0101371 A1 * 4/2016 Grunewald ..... A63H 33/062 446/95

FOREIGN PATENT DOCUMENTS

| | | |
|---|---|---|
| CA | 2258415 A | 7/2000 |
| DE | 3600629 | 8/1986 |
| DK | 037798 | 3/1998 |
| EP | 0357282 | 3/1990 |
| EP | 0490033 | 12/1995 |
| WO | WO1991004775 | 4/1991 |
| WO | WO1999047223 | 9/1999 |

* cited by examiner

CONSTRUCTION TOY SET OF CONNECTABLE AND POSITIONABLE ELEMENTS

BACKGROUND OF THE INVENTION

This invention relates to construction toy sets and systems and more particularly to construction toy sets and systems utilizing interconnectable gender type component features.

There are many types of interconnectable construction toy elements disclosed in the prior art, including many issued US patents and foreign patents. The various construction toys sets and systems disclosed in the prior art present varying opportunities for play and for exploring and developing creativity for the user, with varying degrees of success.

The prior art construction toy sets and systems present varying types of genderless and gender type connections and present varying opportunities for and varying flexibility in interconnecting the interconnectable elements in constructing element assemblies from the construction elements.

It is an objective of the present invention to present a construction toy set with construction elements having new interconnection features which provide for new interconnection options and flexibility and for new assembly options and flexibility for a user, who may be a child, a young person, or an adult.

It is the further objective of the present invention to provide a construction toy set having construction elements which provide for position and rotation options in addition to interconnection options for the user.

SUMMARY OF THE INVENTION

Preferred embodiments of the construction toy set of the present invention include a plurality of construction elements. The construction elements have an element body which is generally wafer shaped and has one or more receiver passages extending through the element body from an element first surface to an element second surface. Each receiver passage has a passage interior peripheral surface extending around the receiver passage. The element body of the construction element may have four element lateral edges with a single receiver passage or multiple receiver passages. Each receiver passage may have four receiver tracks extending laterally across the receiver passage from a respective first track channel in the passage interior peripheral surface to a respective second track channel in the passage interior peripheral surface.

The element body of the construction element may have one or more element keys protruding laterally at an element key side of an element lateral edge of the element body. For a preferred embodiment, each element key may have a common key length and a common key shape and dimensioning. In this specification, including the claims, the term "key dimensioning" shall be defined to include the shape and dimensioning of an element key.

For a preferred embodiment, the key length and key dimensioning may provide for the element key of a second construction element to be inserted in the receiver track of a first construction element, providing for the key element of the second construction element to slidably mate with the first track channel and the second track channel of a receiver track of the first construction element. For a preferred embodiment of construction element, the element key of the second element may be inserted in any of the available receiver tracks of the first construction element, which, depending on the number of receiver tracks provided in the receiver passage, may provide for an element rotated position of the second construction element with respect to the first construction element.

For preferred embodiments of the two receiver passage construction elements, the first body portion may be identical to the second body portion. A first connection side of the first body portion may be connected to a second connection side of the second body portion by one or more element bridges which interconnect the first body portion to the second body portion. For preferred embodiments of the construction elements having any number of a plurality of body portions, the body portion interior sides of the contiguous body portions may preferably be connected by two or more bridge elements, while the un-connected body portion sides of each body portion may preferably have an element key.

For preferred embodiments, the element key length and the element key dimensioning, together with uniformity in the receiver track length and channel track shape and dimension uniformity, will provide for the insertion of the element key of a second construction element in any of the receiver tracks of the first construction element.

Slidable construction elements may also be included in the preferred embodiment of the construction toy set of the present invention. For preferred embodiments of the slidable construction element, the slidable element width may match the receiver track length of the respective receiver tracks of the receiving construction element as well as the other construction elements of the construction toy set. The slidable construction element of the preferred embodiments may have a uniform slidable element width, regardless of the number of slidable receiver passages and may have a slidable element edge shape which matches the shape of the first track channel and the second track channel of the receiving construction element as well as the other construction elements of the construction toy set, thereby providing for the slidable mating of the slidable construction elements with each of the respective receiver tracks of the construction elements of the construction toy set. Embodiments of the construction element having any number of a plurality of receiver passages with uniformly dimensioned and shaped receiver tracks and uniformly dimensioned and shaped element keys may be assembled together in a variety of configurations. There will be numerous interconnection options available for interconnection between construction elements and slidable construction elements as well as interconnections between respective slidable construction elements.

Preferred embodiments may provide for uniform dimensioning and uniform shape as described previously for the construction elements, and uniform dimensioning and uniform shape of the slidable construction elements, thereby providing for maximum compatibility, flexibility, and variability in the interconnections that can be achieved by the user in building, erecting and fabricating construction element assemblies. The benefits of uniformity and compatibility will be obvious to persons of ordinary skill in the art of in view of the drawings and this specification. However, alternative embodiments of the construction toy set of the present invention may be provided having construction elements and slidable construction elements with element bodies, receiver passages, receiver tracks, and element keys, with more than one set of shapes and dimensions. While variations may result in the incompatibility and non-connectivity of some of the construction elements and slidable construction elements, they may provide for some additional complexity and additional learning experience of users of the construction toy set of the present invention. The construction toy set of the present invention may also include various accessory elements are which may provide additional activity options and may promote additional interest and enjoyment for the user, as well as additional learning and educational opportunities.

The construction toy set of the present invention may incorporate single receiver passage elements, construction elements having a plurality of receiver passages, slidable construction elements, and accessory elements. Various combinations of the construction elements of the present invention may be incorporated in the construction toy set of the present invention, based on factors such as age of the user or cost.

BRIEF DESCRIPTIONS OF THE DRAWINGS

Figure 10:
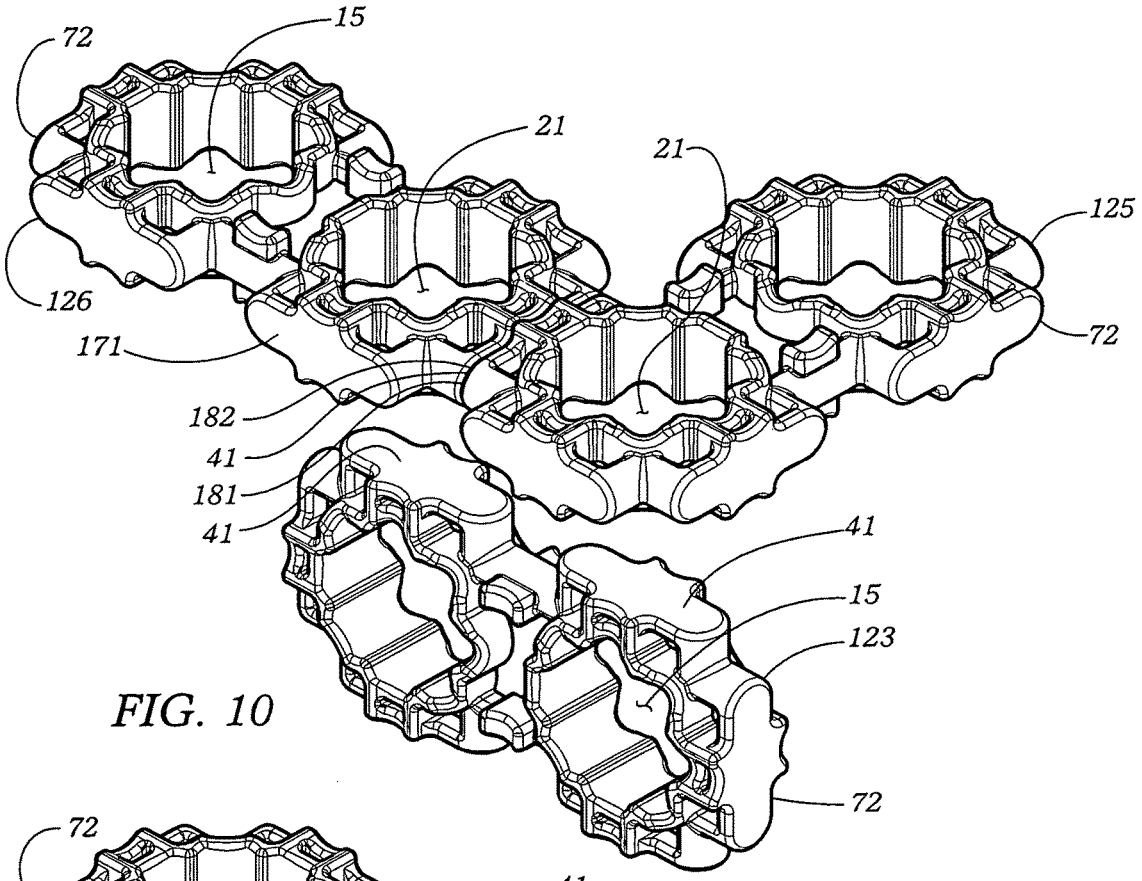

FIG. 10 is perspective view of three, two receiver passage construction elements, an element key of a second construction element being abutted to an element key of a third construction element, and the three constructed elements aligned for the insertion of one element key of the first construction element in a receiver track of a receiver passage of the second construction element and for the insertion of a second element key of the first construction element in a receiver track of a receiver passage of the third construction element.

Figure 11:
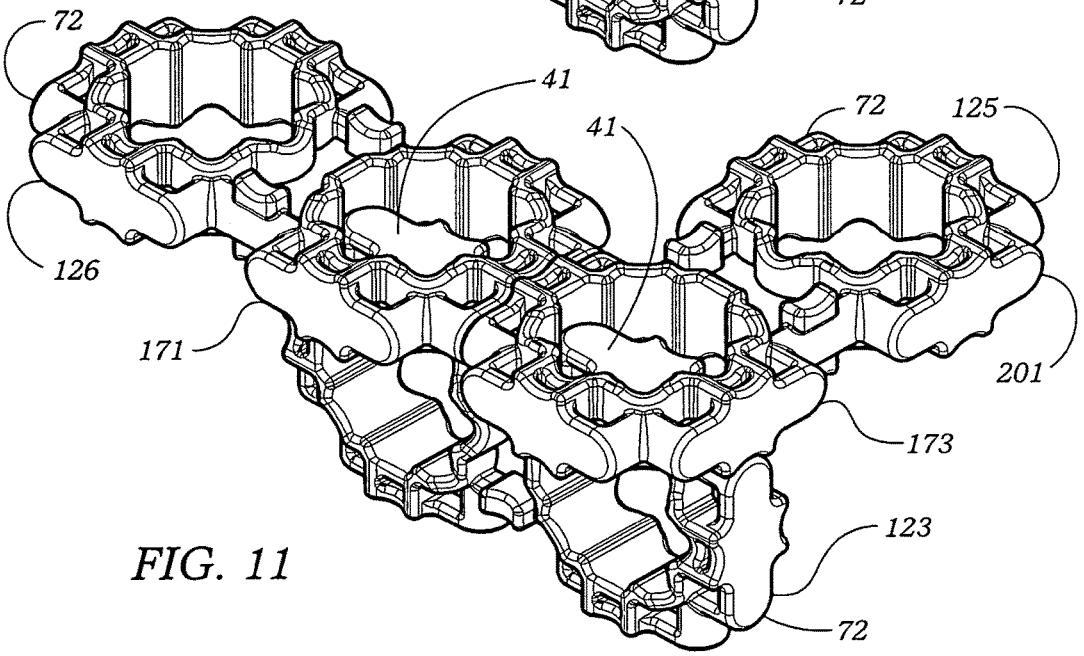

FIG. 11 is perspective view of three, two receiver passage construction elements, an element key of a second construction element being abutted to an element key of a third construction element, and the three constructed elements interconnected by the insertion of one element key of the first construction element in a receiver track of a receiver passage of the second construction element and by the insertion of a second element key of the first construction element in a receiver track of a receiver passage of the third construction element.

Figure 12:
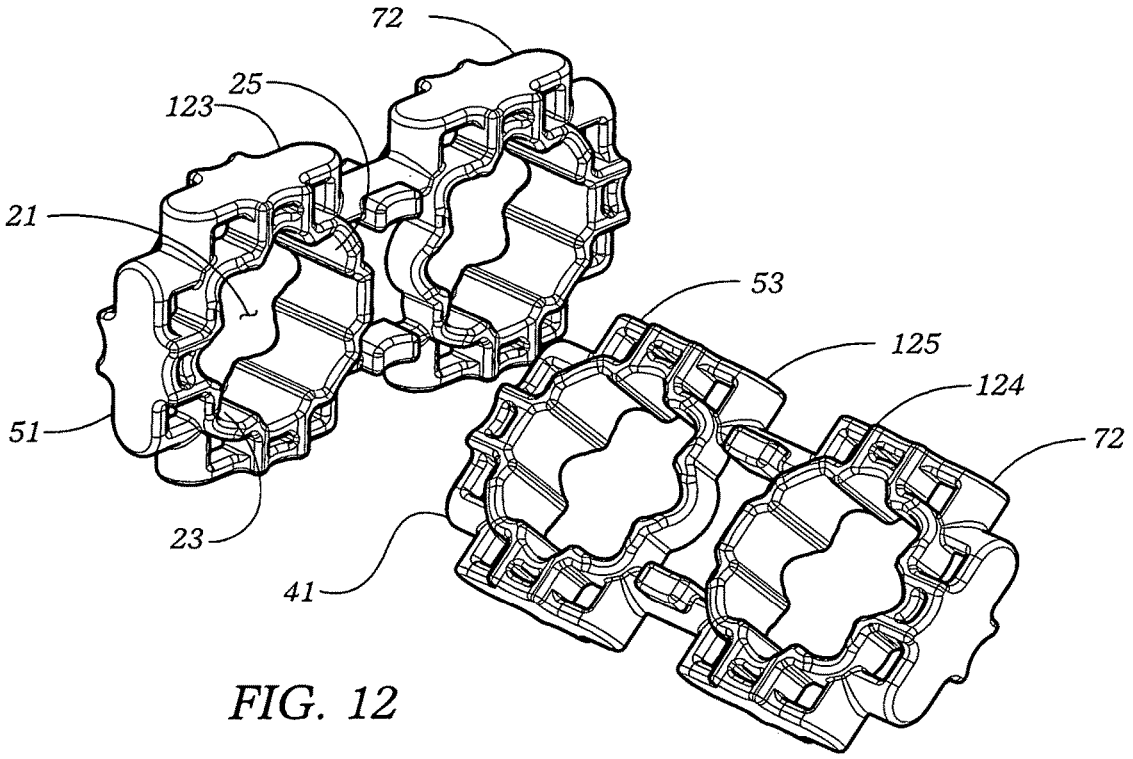

FIG. 12 is perspective view of two, two receiver passage construction elements aligned for an element key of a second construction element to be inserted in an element rotated position in a receiver track of a first construction element.

Figure 13:
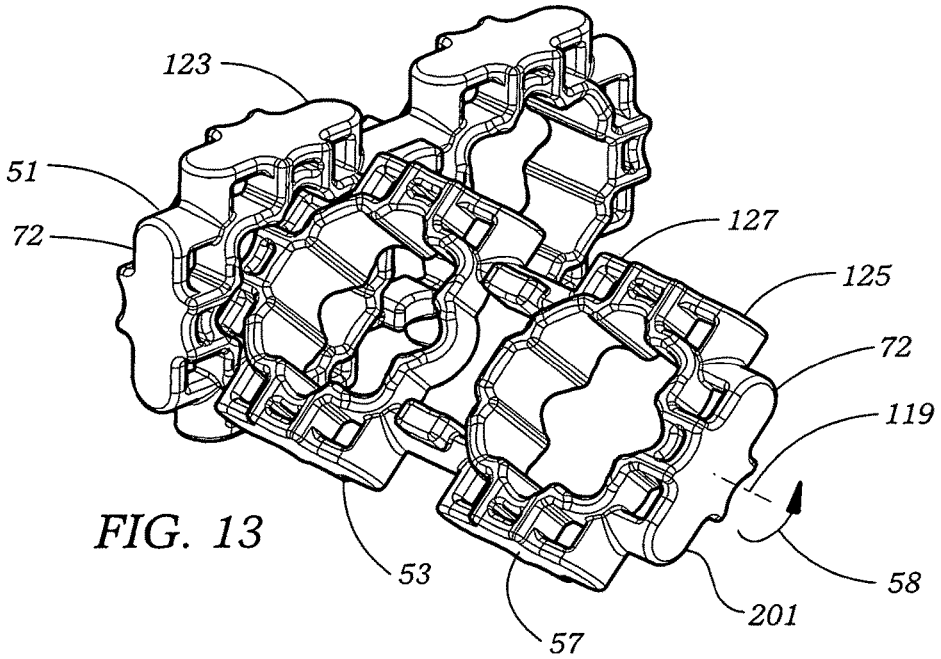

FIG. 13 is perspective view of two, two receiver passage construction elements with an element key of a second construction element inserted in an element rotated position in a receiver track of a first construction element.

Figure 14:
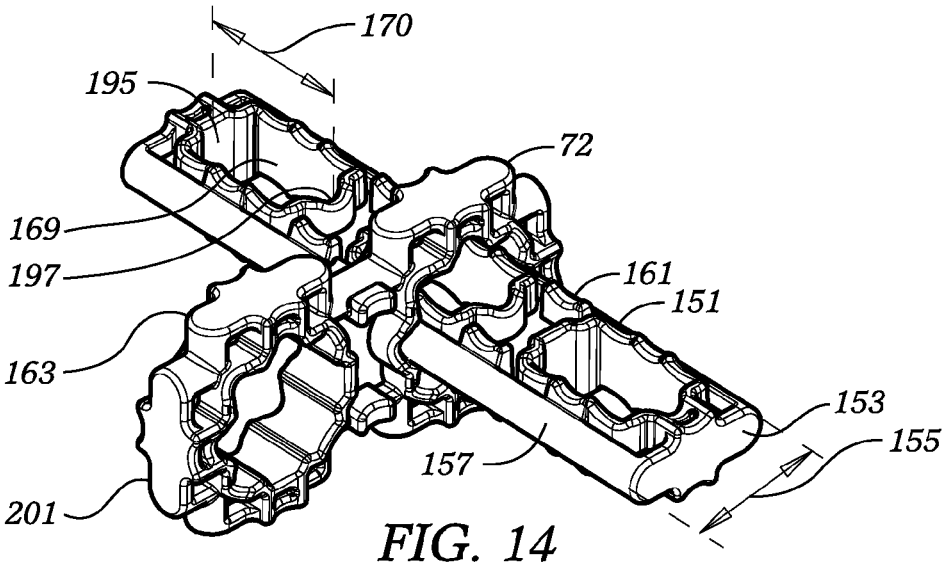

FIG. 14 is a perspective view of a preferred embodiment of a three receiver passage slidable construction element of the construction toy set of the present invention shown in a slidable element inserted configuration with a two receiver passage construction element.

Figure 15:
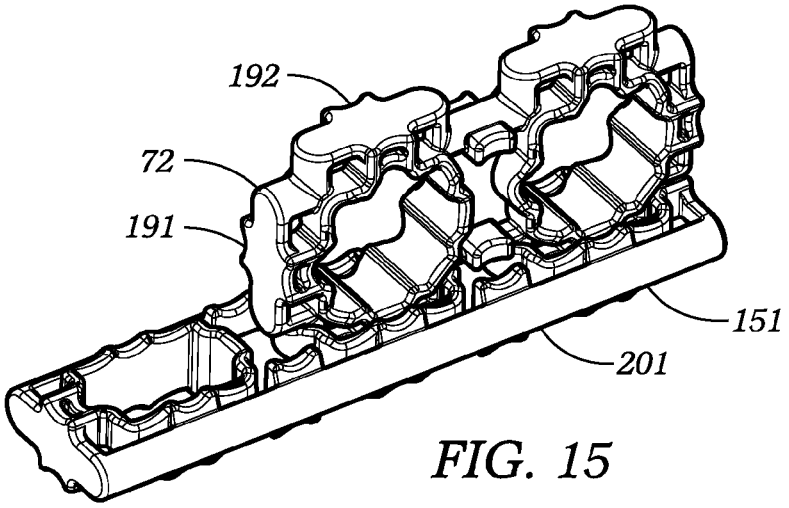

FIG. 15 is a perspective view of a preferred embodiment of a three receiver passage slidable construction element of the construction toy set of the present invention shown with two adjacent element keys of a two receiver passage construction element inserted in adjacent receiver tracks of the slidable construction element.

Figure 16:
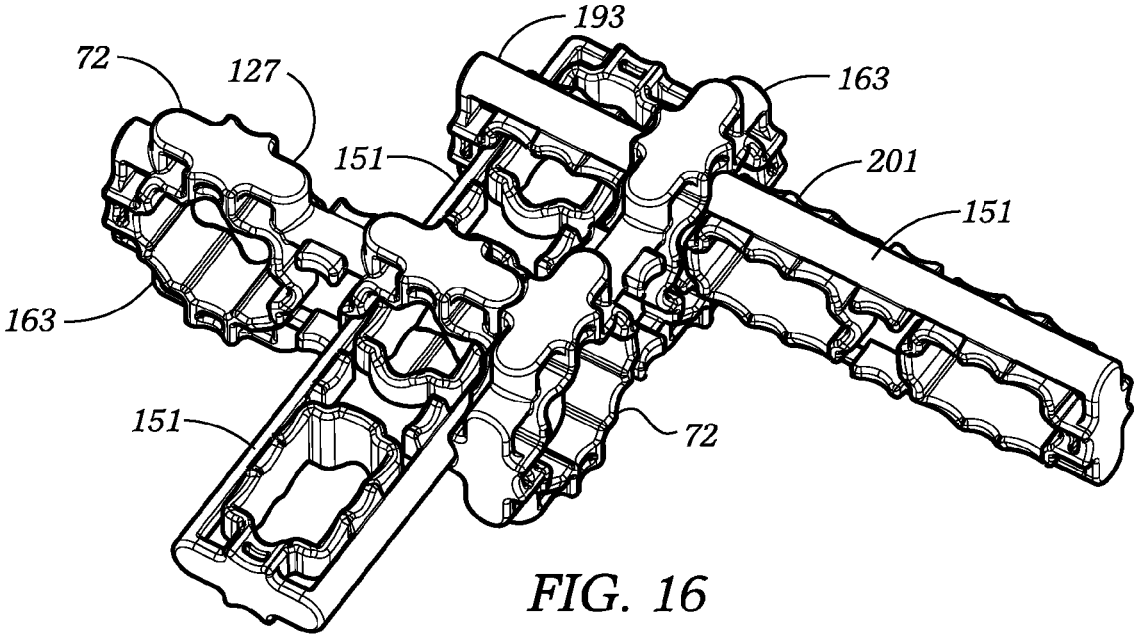

FIG. 16 is a perspective view of an illustration of an interconnection of two, two receiver passage construction elements and two, three receiver passage slidable construction elements of the construction toy set of the present invention.

Figure 17:
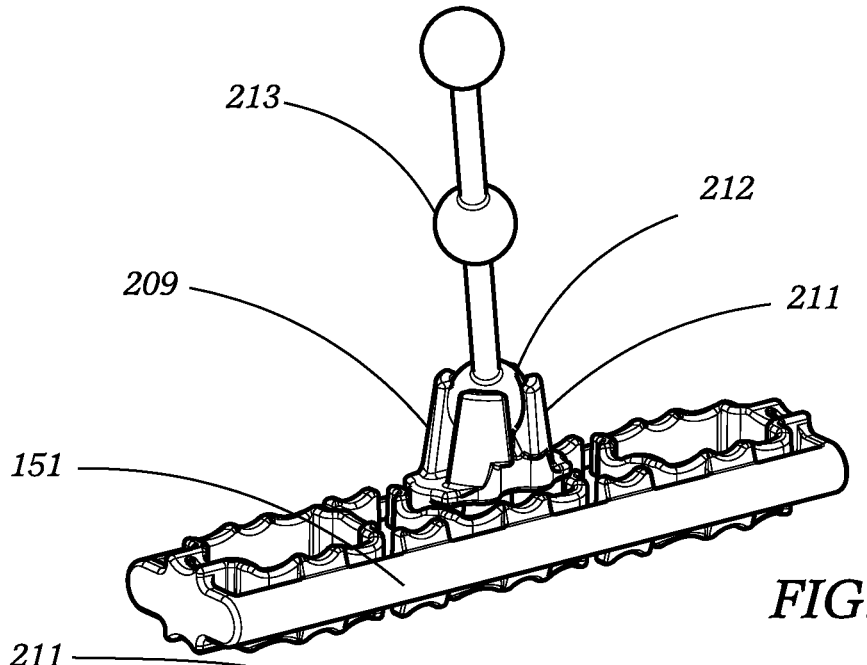

FIG. 17 is a perspective view of an optional accessory element of the construction toy set of the present invention which is a socket element accessory having a ball receptacle for a ball of a ball and rod element.

Figure 18:
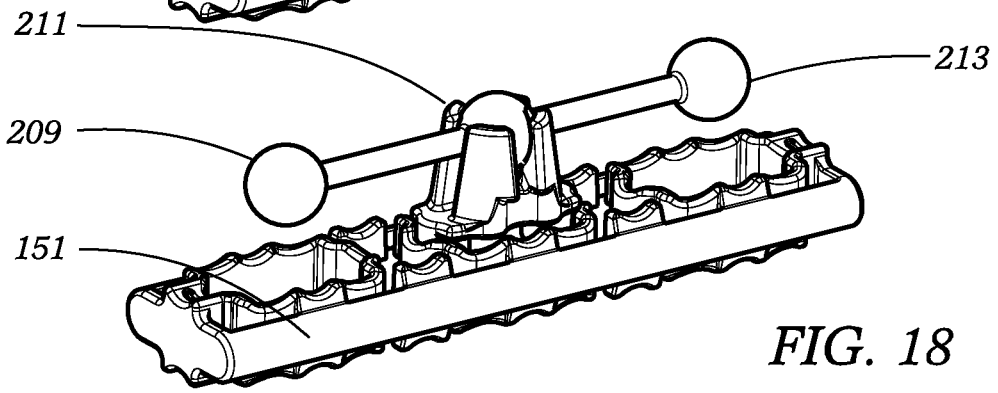

FIG. 18 is a perspective view which illustrates an additional configuration for utilization of the socket element and the ball and rod element of FIG. 17.

Figure 19:
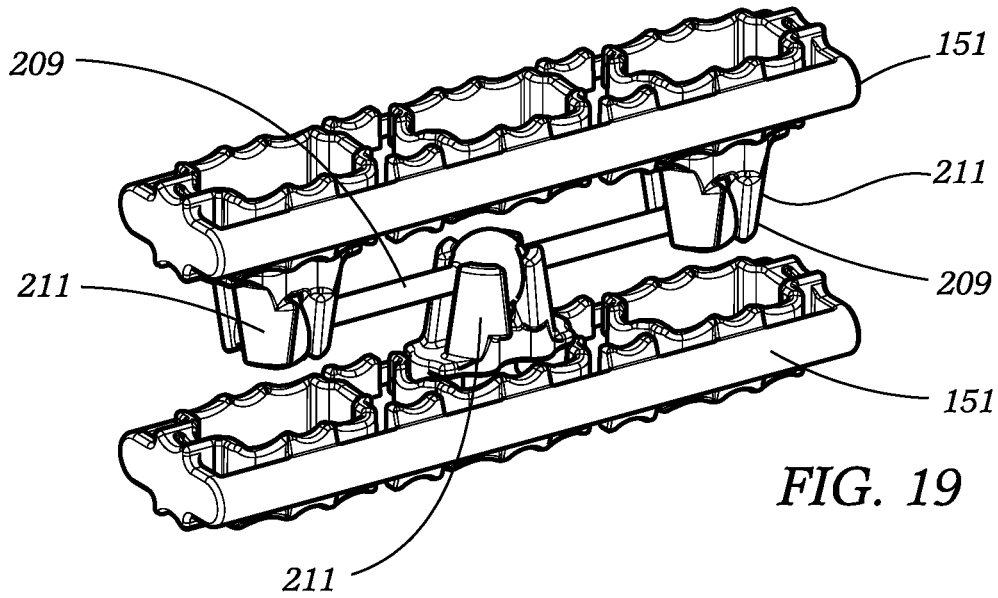

FIG. 19 is a perspective view which illustrates an additional configuration for utilization of the socket element and the ball and rod element of FIG. 17.

Figure 20:
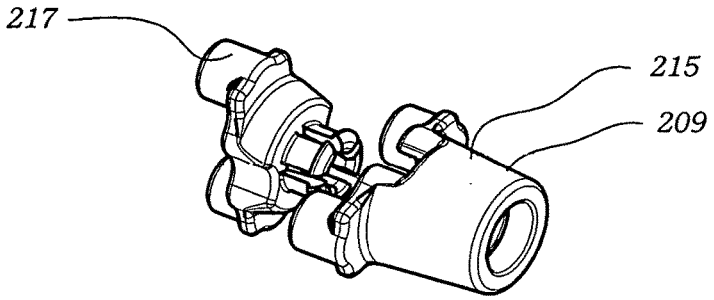

FIG. 20 is a perspective view of an optional accessory element of the construction toy set of the present invention which is a sleeve element interconnected with a snap element.

Figure 21:
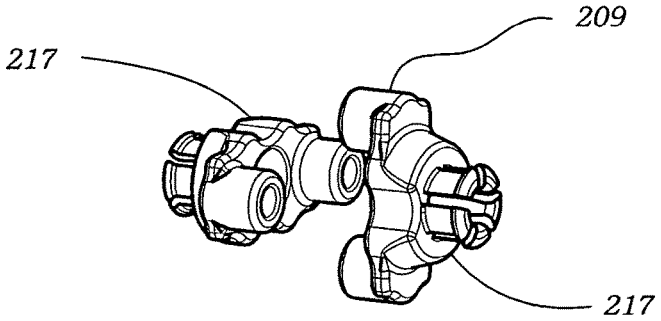

FIG. 21 is a perspective view of an optional accessory element of the construction toy set of the present invention which is two snap units which may be positioned in perpendicular receiver tracks in a receiver passage.

Figure 22:
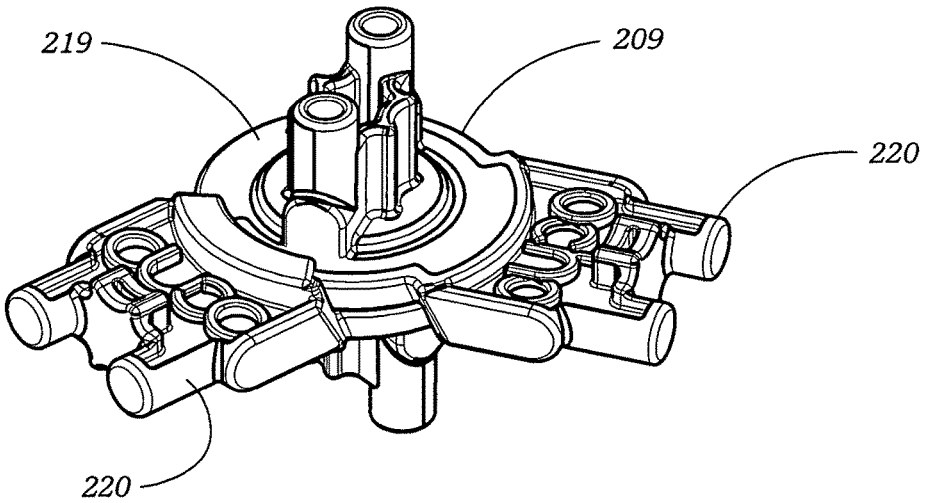

FIG. 22 is a perspective view of an optional accessory element of the construction toy set of the present invention which is a pivot element which be may pivotally interconnected with construction elements and slidable construction elements.

Figure 23:
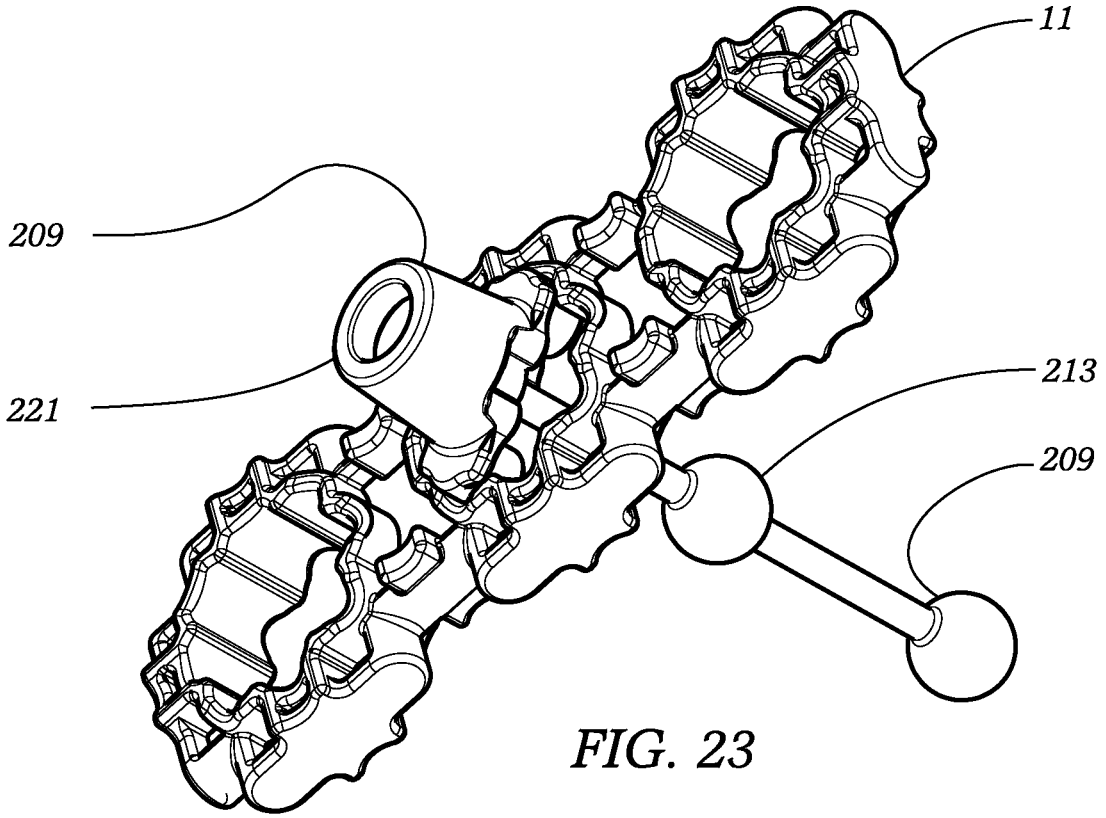

FIG. 23 is a perspective view of an optional accessory element of the construction toy set of the present invention which illustrates a ball joint element which may provide another connection option for a ball and rod element.

Figure 24:
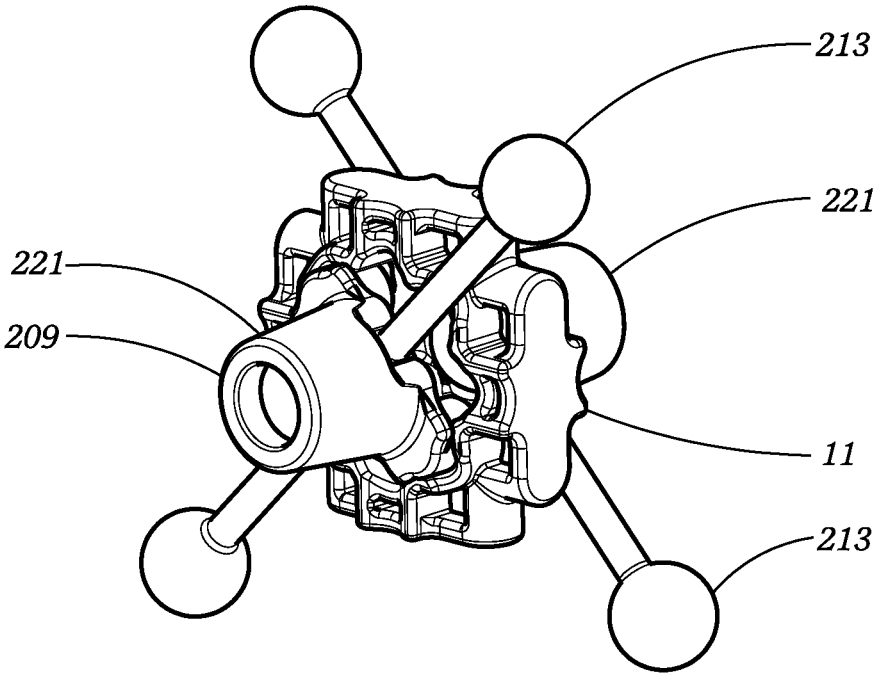

FIG. 24 is a perspective view of an optional accessory element of the construction toy set of the present invention which illustrates a ball joint element which may provide another connection option for ball and rod element, with opposing ball joint elements installed in opposing sides of a construction element, each ball joint element having a connected ball rod element.

Figure 25:
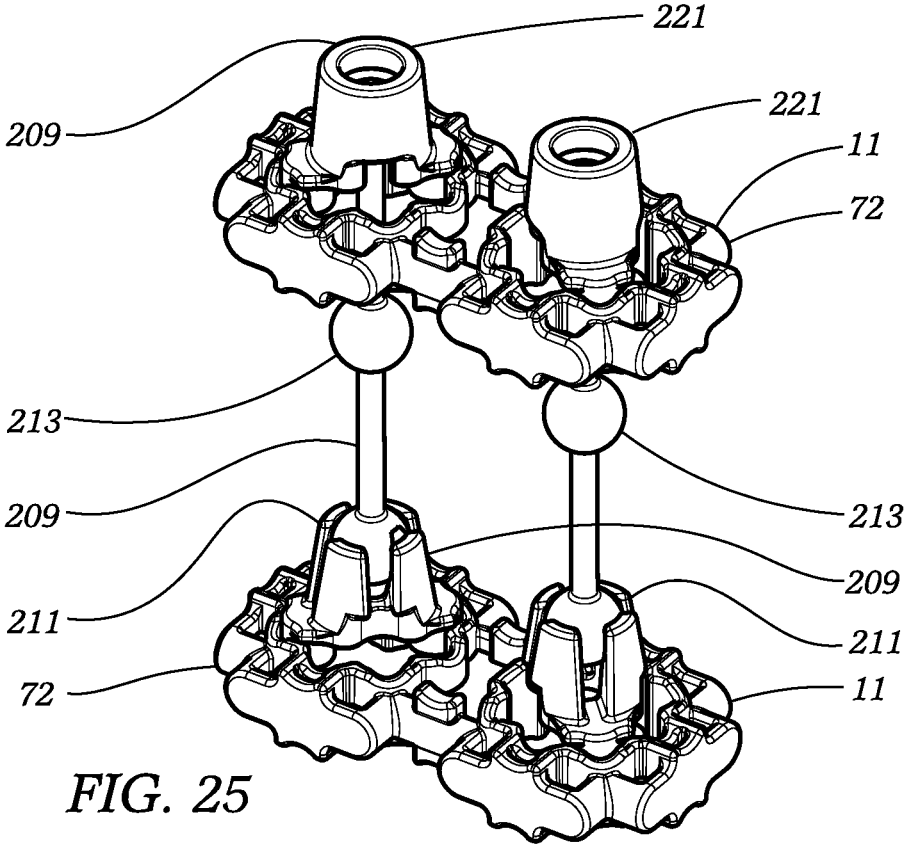

FIG. 25 is a perspective view of an optional accessory element of the construction toy set of the present invention illustrating use of ball joint elements, socket elements, and ball rod elements, in conjunction with a pair of two receiver passage construction elements.

Figure 26:
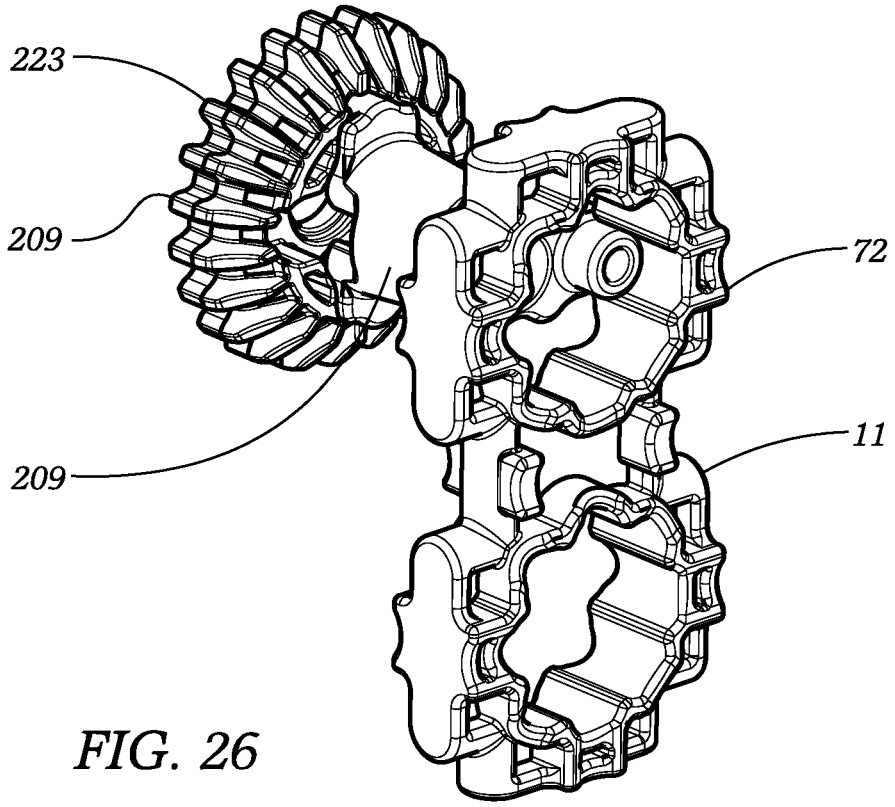

FIG. 26 is a perspective view of an optional accessory element of the construction toy set of the present invention which is an embodiment of a wheel element.

Figure 27:
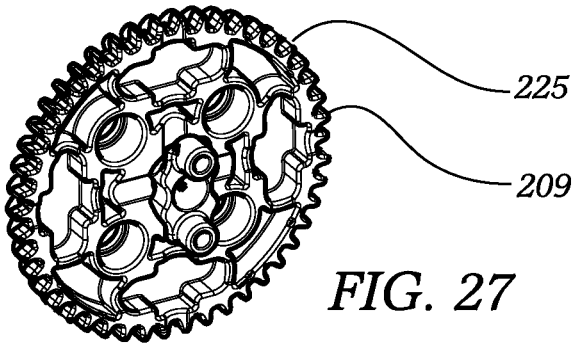

FIG. 27 is a perspective view of an optional accessory element of the construction toy set of the present invention which is a further embodiment of a wheel element.

Figure 28:
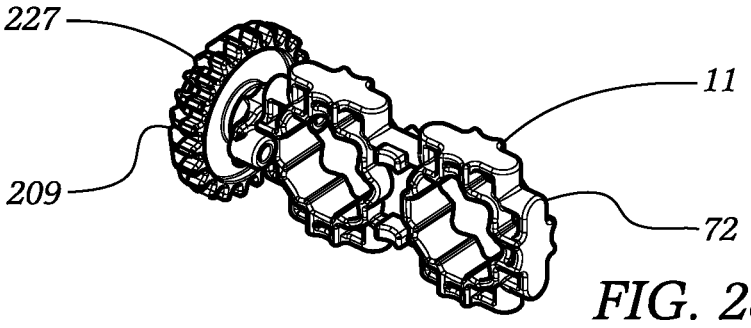

FIG. 28 is a perspective view of an optional accessory element of the construction toy set of the present invention which is a further embodiment of a wheel element.

Figure 29:
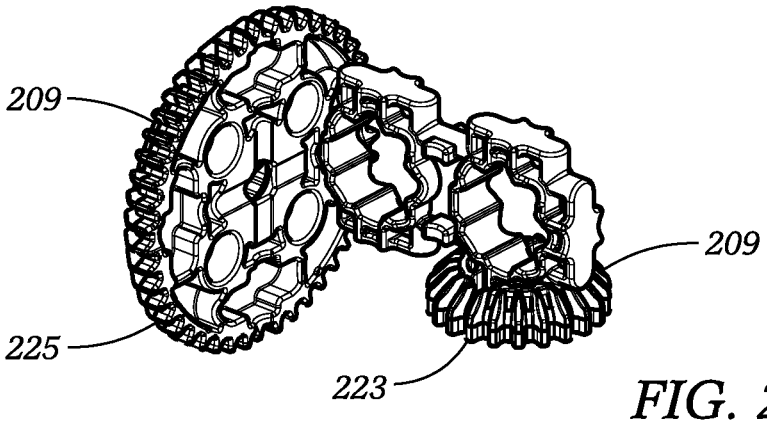

FIG. 29 is a perspective view of an optional accessory element of the construction toy set of the present invention which is a further embodiment of a wheel element.

Figure 30:
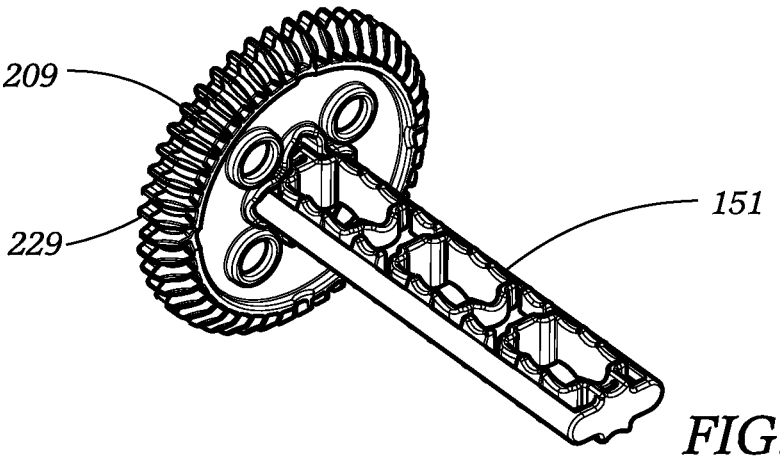

FIG. 30 is a perspective view of an optional accessory element of the construction toy set of the present invention which is a further embodiment of a wheel element.

FIG. 25 is a perspective view of an optional accessory element of the construction toy set of the present invention which is a further embodiment of a wheel element.

Figure 31:
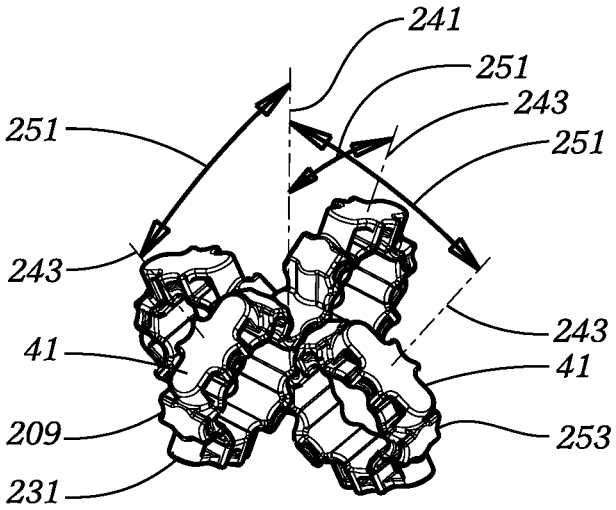

FIG. 31 is a perspective view of an optional accessory element of the construction toy set of the present invention which is an irregular construction element with four body portions, each body portion having two element keys, each of the element keys having a key axis with a key angular displacement from a bridge axis which is other than ninety degrees.

Figure 32:
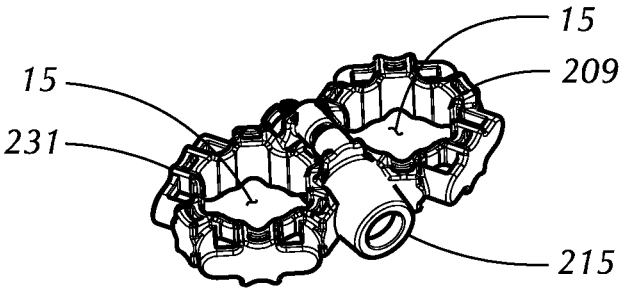

FIG. 32 is a perspective view of an optional accessory element of the construction toy set of the present invention which is an irregular construction element with two receiver passages engaged by a ball joint element.

Figure 33:
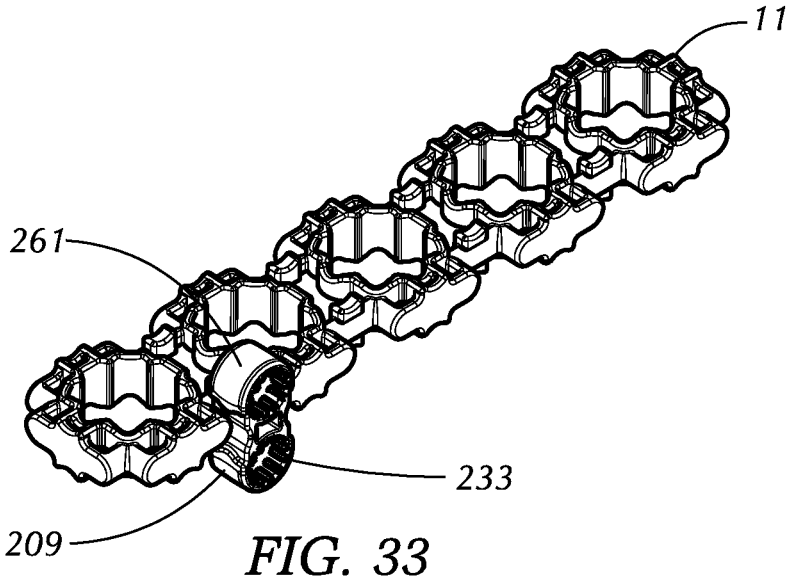

FIG. 33 is a perspective view of an optional accessory element of the construction toy set of the present invention which a lever arm shown nested on a multiple receiver passage construction element.

Figure 34:
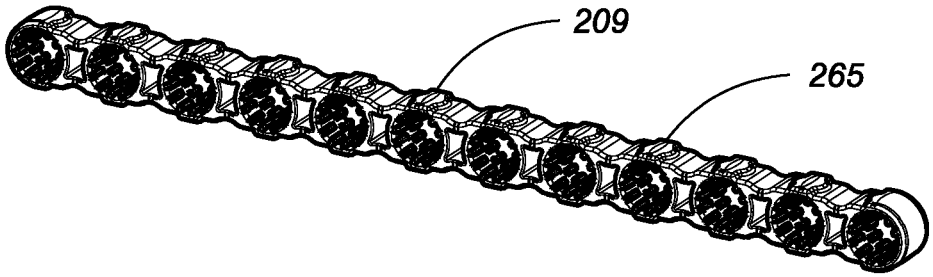

FIG. 34 is a perspective view of an optional accessory element of the construction toy set of the present invention which is a multiple-unit lever arm.

Figure 35:
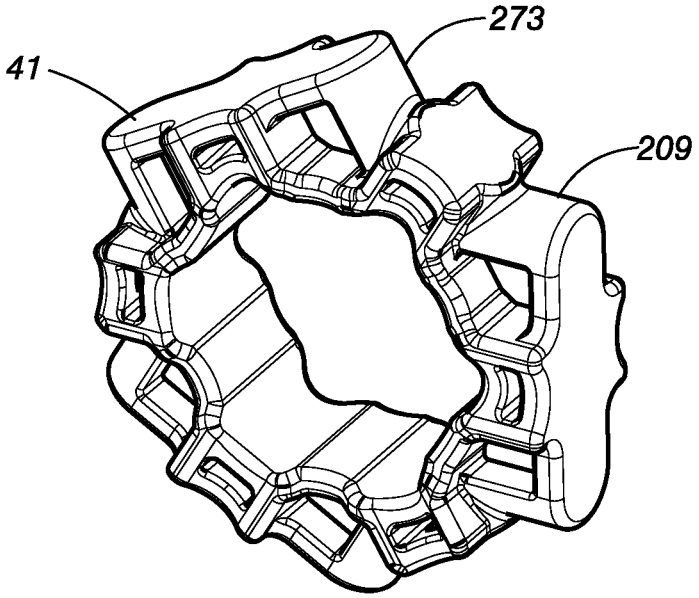

FIG. 35 is a perspective view of an optional accessory element of the construction toy set of the present invention which is an irregular construction element with three element keys.

Figure 36:
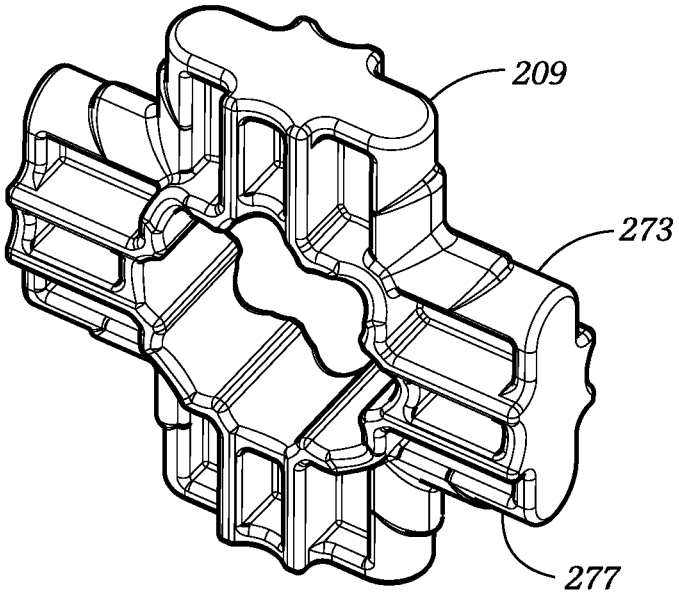

FIG. 36 is a perspective view of an optional accessory element of the construction toy set of the present invention which is an irregular construction element with extended element keys.

Figure 37:
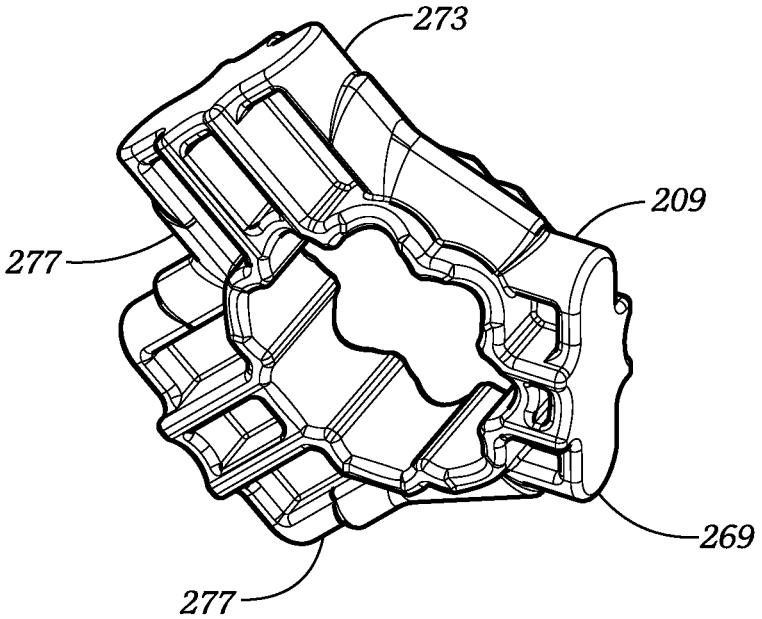

FIG. 37 is a perspective view of an optional accessory element of the construction toy set of the present invention which is an irregular construction element with two perpendicular extended element keys and one irregular element key.

DETAILED DESCRIPTION

Figure 1:
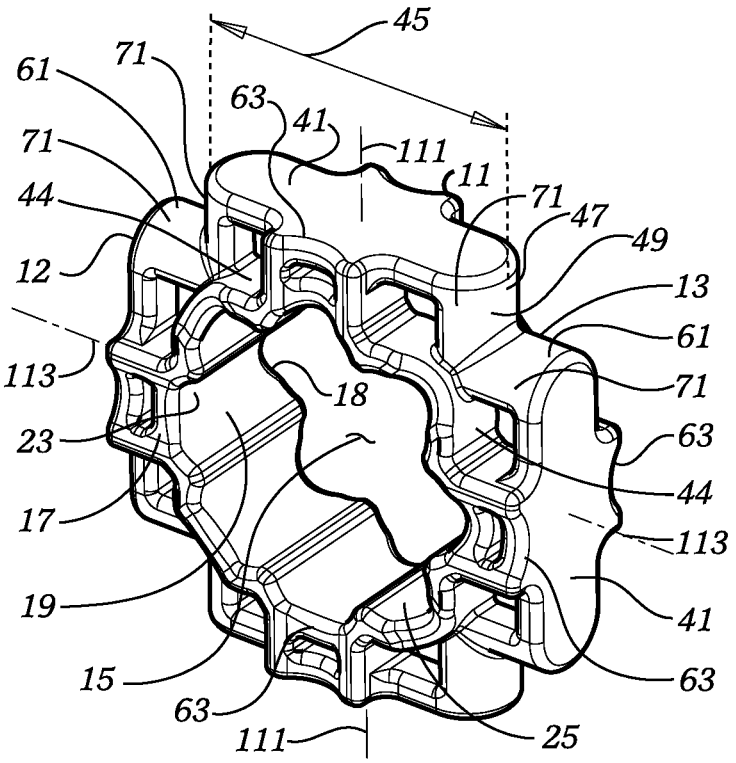
FIG. 1 is a perspective view of a preferred embodiment of a construction element of a construction toy set of the present invention, the construction element having a single receiver passage.

Referring to FIG. 1 a perspective view of a construction element 11 of a construction toy set of the present invention is shown. The embodiment of the construction element 11 shown in FIG. 1, namely a single receiver passage construction element 12, has an element body 13 which is generally wafer shaped and has a single receiver passage 15 extending through the element body 13 from the element first surface 17 to the element second surface 18, the receiver passage 15 having a passage interior peripheral surface 19 extending around the receiver passage 15. The element body 13 of the construction element 11 shown in FIG. 1 has four element lateral edges 44.

Figure 2:
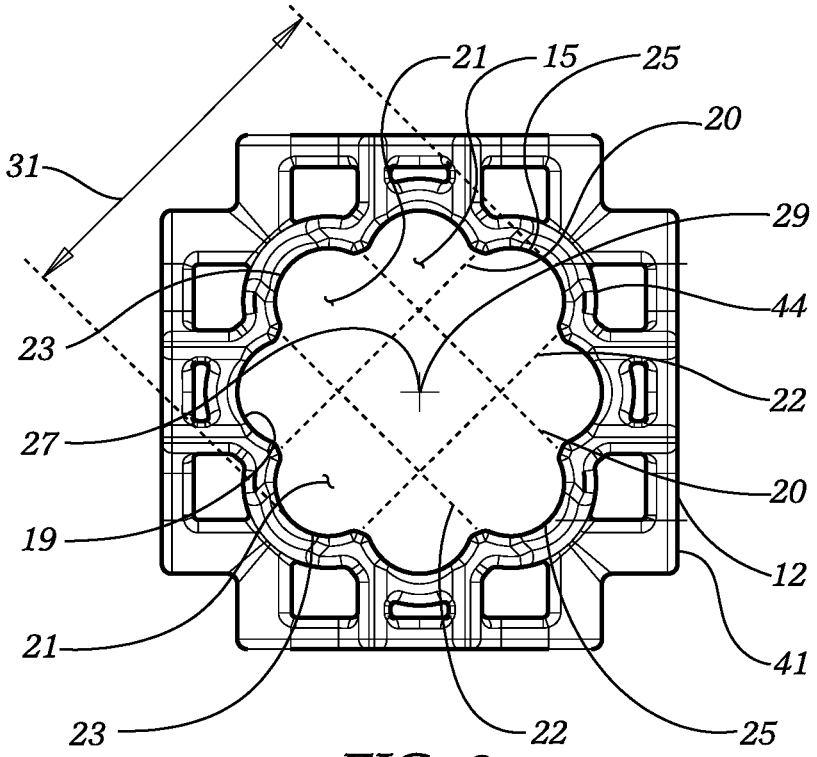
FIG. 2 is a plan view of the embodiment of the single receiver passage construction element shown in FIG. 1, the receiver passage having four receiver tracks and four element keys.

Referring also to FIG. 2, which is a plan view of the embodiment of the single receiver passage construction element 12 shown in FIG. 1, the receiver passage 15 has four receiver tracks 21, two of which are identified in FIG. 2 by a first channel track line 20 and a second channel track line 22 extending laterally across the receiver passage 15 from a respective first track channel 23 in the passage interior peripheral surface 19 to a respective second track channel 25 in the passage interior peripheral surface 19. The receiver passage 15 may have a passage central axis 27 which, for the embodiment shown in FIG. 1, may be generally perpendicular to the element first surface 17 and the element second surface 18. For the embodiment of the receiver passage 15 shown, each receiver track 21 may have a track central axis 29 which may be aligned with the passage central axis 27 of the receiver passage 15. However, while the embodiment of the construction element 11 shown in FIG. 1 and FIG. 2 has a symmetrical receiver passage 15 with a symmetrical passage interior peripheral surface 19, other embodiments may merely provide for a common receiver track length 31 from the first track channel 23 to the second track channel 25 for each receiver track 21. Further, while the preferred embodiment of the construction element 11 shown in FIG. 1 and FIG. 2 has four receiver tracks 21, other embodiments of the construction element 11 may have less or more than four receiver tracks 21. Preferred embodiments of the construction element 11 having more than one body portion 131 and more than one receiver passage 15, such as those shown in FIG. 5 and FIG. 33, may also have less or more than four receiver tracks 21. Further, although the preferred embodiments of the construction element 11 shown in FIG. 5 and FIG. 33 and other figures have the same number of receiver tracks 21, other embodiments may have differing numbers of receiver tracks 21 in respective receiver passages 15.

Referring further to FIG. 1, the element body 13 of the construction element 11 may have one or more element keys 41. For the construction element 11 shown in FIGS. 1 and 2, the element body 13 has four element keys 41, one element key 41 protruding laterally at each element key side 49 of each element lateral edge 44 of the element body 13. For a preferred embodiment, each element key 41 may have a common key length 45 and a common key shape and dimensioning 47. In this specification, including the claims, the term "key dimensioning" shall be defined to include the shape and dimensioning of an element key 41.

Figure 3:
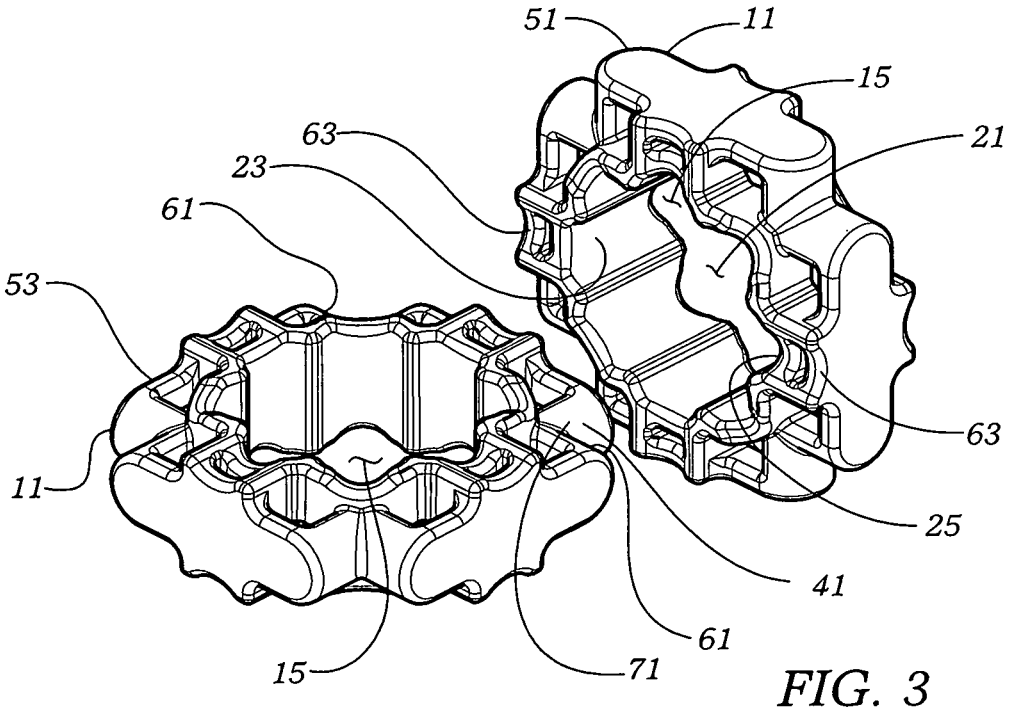
FIG. 3 is perspective view of two single receiver passage construction elements aligned for an element key of a second construction element to be inserted in a receiver track of a first construction element.
Figure 4:
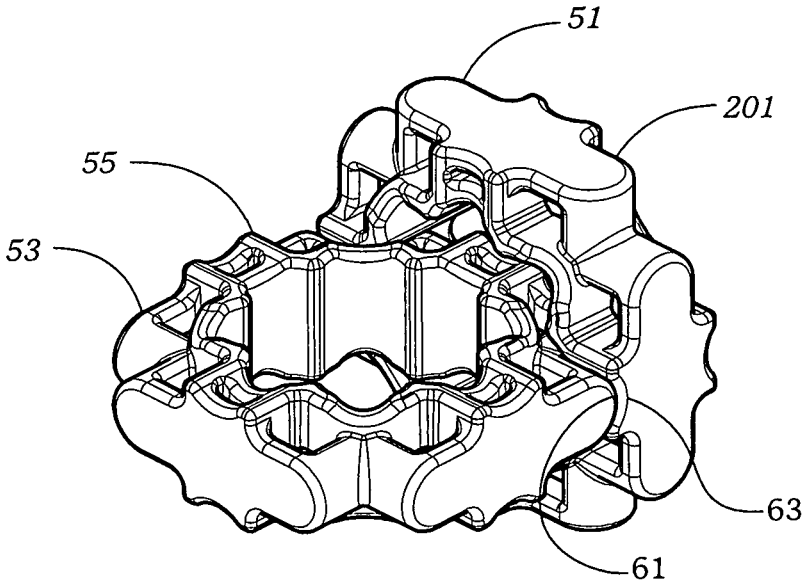
FIG. 4 is perspective view of two single receiver passage construction elements with an element key of a second construction element inserted in a receiver track of a first construction element.

For a preferred embodiment, the key length 45 and key dimensioning 47 may provide for the element key 41 of a second construction element 53 to be inserted in a receiver track 21 of a first construction element 51, as shown in FIGS. 3 and 4, providing for the key element 41 of the second construction element 53 to slidably mate with the first track channel 23 and the second track channel 25 of a receiver track 21 of the first construction element 51 and for the second construction element 53 to attain an element inserted position 55 as shown in FIG. 4. For a preferred embodiment of construction element 11, any element key 41 of the second element 53 may be inserted in any of the available receiver tracks 21 of the first construction element 51 which, depending on the number of receiver tracks 21 provided in the receiver passage 15, may provide for an element rotated position 57 of the second construction element 53 with respect to the first construction element 51 as shown in FIGS. 12 and 13.

Referring now to FIG. 1 and FIG. 3 the preferred embodiments of the element body 13 of the construction element 11 have key shoulders 61 adjacent to the key wall 71 of the element key 41, which key shoulder 61, for preferred embodiments, also constitutes a key wall 71 of the adjacent element key 41, the key shoulders 61 of element key 41 of the second construction element 53 mating with the shoulder receivers 63 of the first construction element 51 as the element key 41 of the second construction element 53 is inserted in a receiver track 21 of the first construction element 51 as shown in FIG. 4 and FIG. 13.

Figure 5:
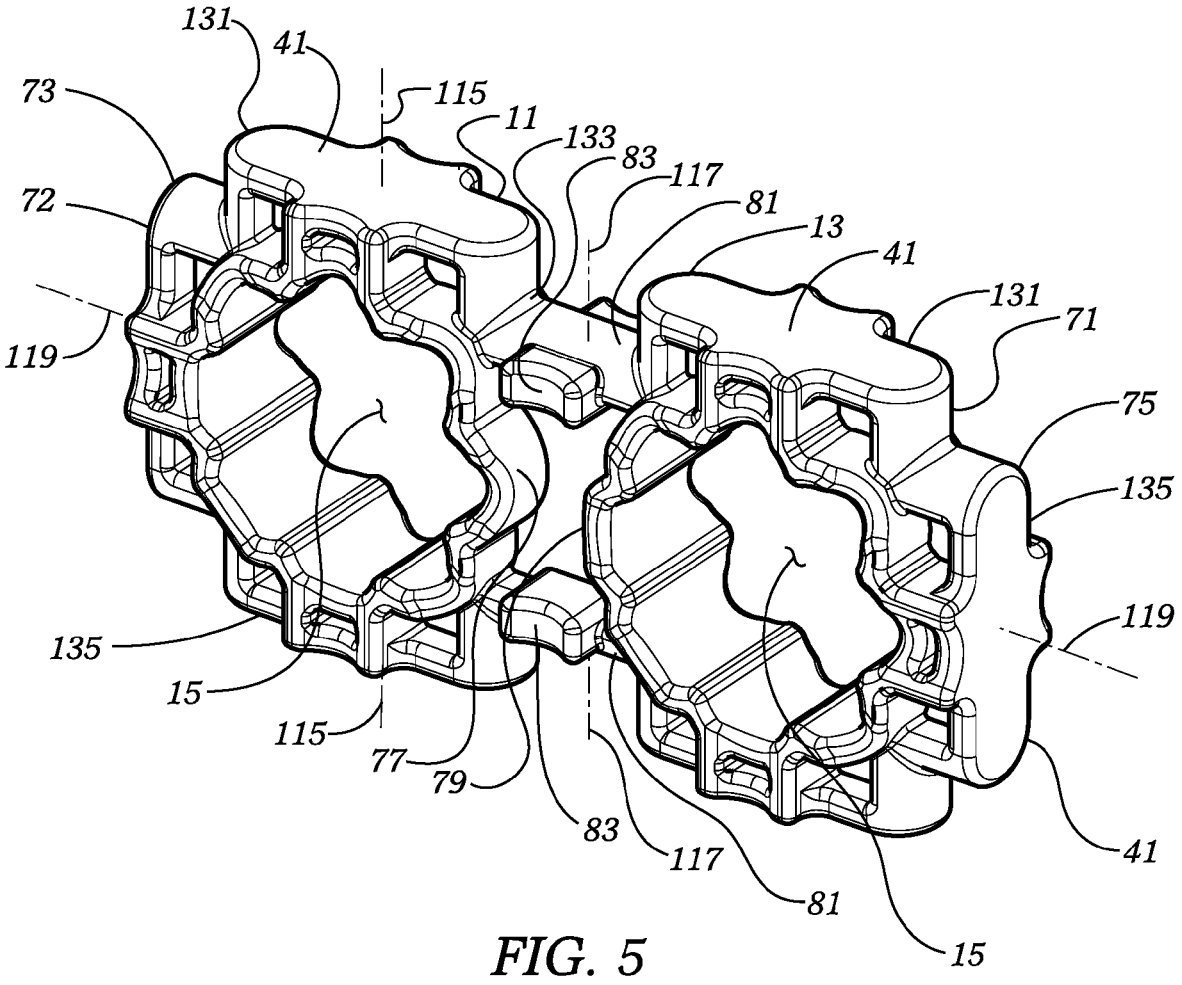
FIG. 5 is a perspective view of a preferred embodiment of a construction element of a construction toy set of the present invention, the construction element having two receiver passages.
Figure 8:
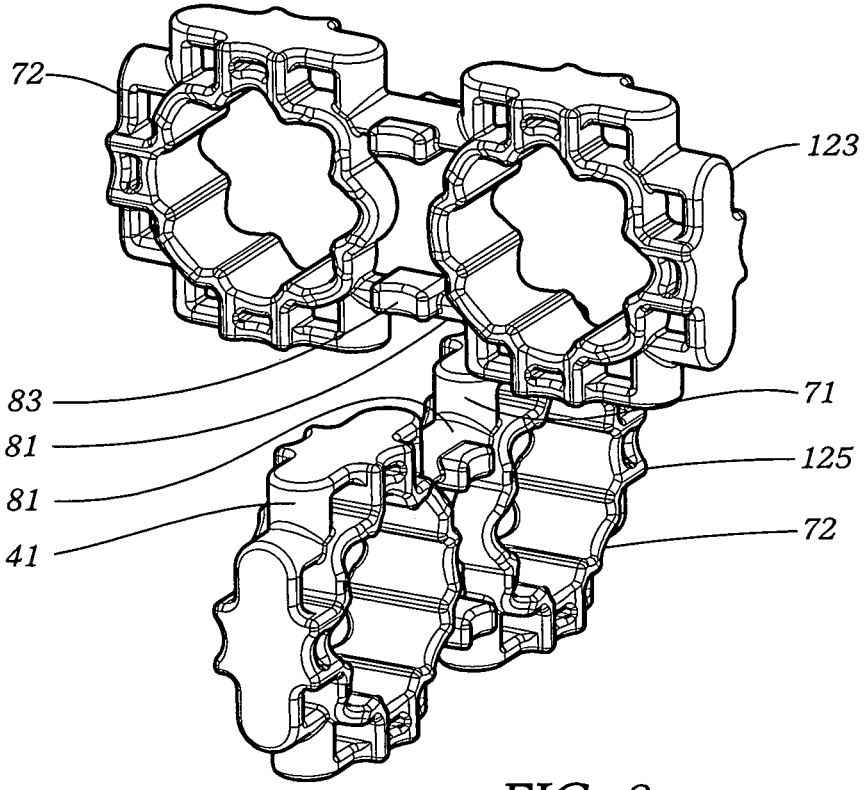
FIG. 8 is perspective view of two, two receiver passage construction elements aligned for the two construction elements to be interconnected at an element bridge of each construction element.
Figure 9:
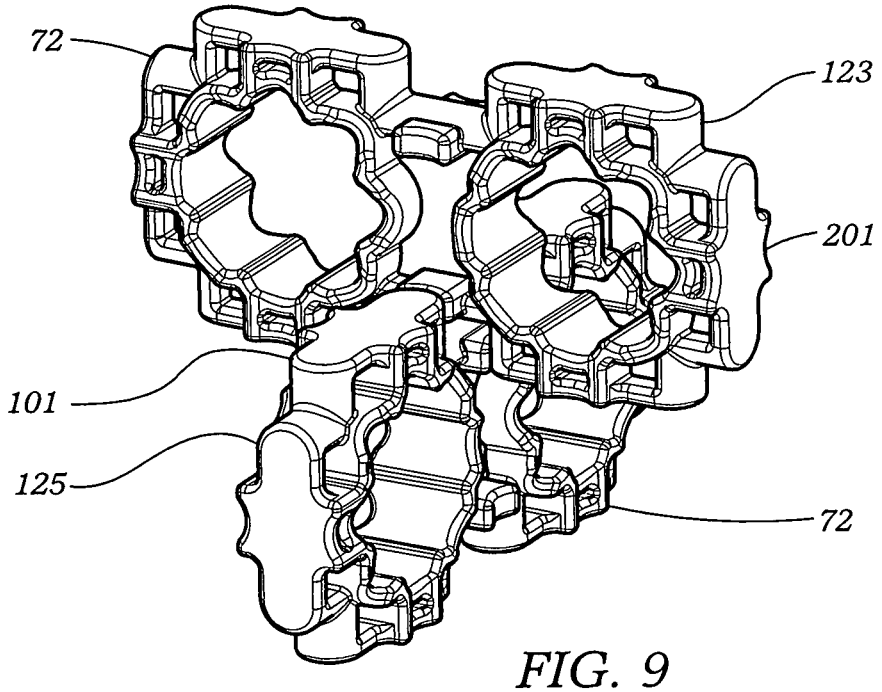
FIG. 9 is perspective view of two, two receiver passage construction elements interconnected at an element bridge of each construction element.

Referring now to FIG. 5, another preferred embodiment of the construction element 11 is shown which has an element body 13 with two receiver passages 15 which may be uniform in shape and dimension. For preferred embodiments of the two receiver passage construction elements 72 of the construction toy set of the present invention shown, the first body portion 73 may be identical to the second body portion 75. A first connection side 77 of the first body portion 73 may be connected to a second connection side 79 of the second body portion 75 by one or more element bridges 81 which interconnect the first body portion 73 to the second body portion 75. Two element bridges 81 are illustrated in FIG. 5. Additional element bridges 81 may be provided, depending, for example, on the size of the construction elements 11, if desired for structural stability. Bridge receivers 83 of a first two receiver construction element 123 may be shaped and dimensioned to slidably mate with the element keys 41 of a second two receiver construction element 125 thereby providing for the nesting configuration 101 of a first two receiver construction element 123 to a second two receiver construction element 125 as illustrated in FIGS. 8 and 9.

Referring again to FIG. 1, for a preferred embodiment of a single receiver passage construction element 12, the element body 13 may be symmetrical about a single passage first axis 111 and a single passage second axis 113. Likewise, as shown in FIG. 5, a preferred embodiment of a two receiver passage construction element 72 may have an element body 13 which is symmetrical about a two receiver passage element bridge axis 117 and a two receiver passage longitudinal axis 119. Except for the body portion interior side 133 of interconnected body portions 131, the body portions 131 may be symmetrical about an body portion axis 115.

Figure 6:
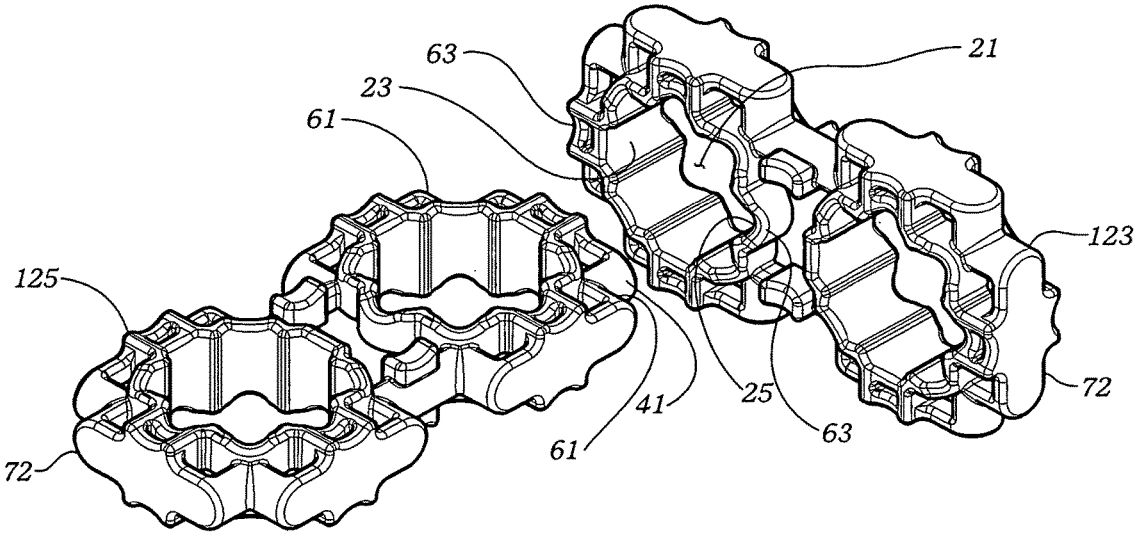
FIG. 6 is perspective view of two, two receiver passage construction elements aligned for an element key of a second construction element to be inserted in a receiver track of a first construction element.
Figure 7:
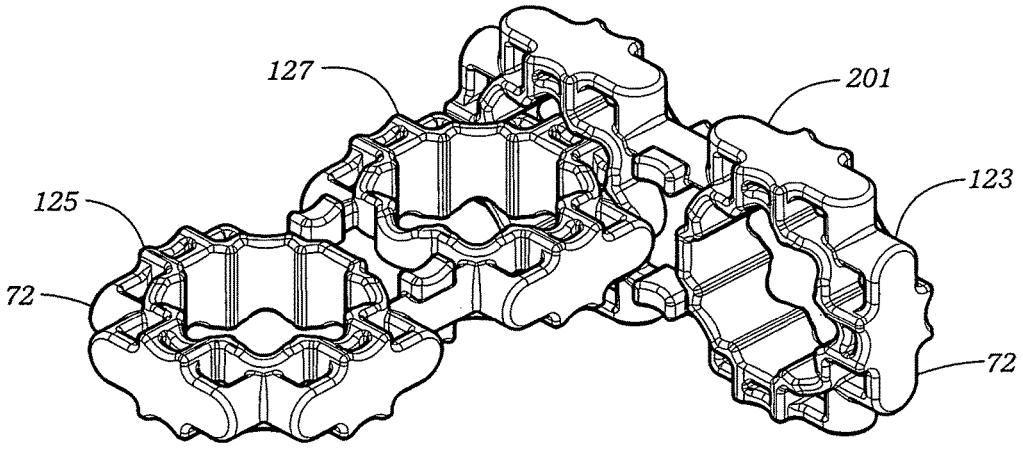
FIG. 7 is perspective view of two, two receiver passage construction elements with an element key of a second construction element inserted in a receiver track of a first construction element.

Referring now to FIGS. 6 and 7, these figures illustrate the insertion of the element key 41 of a preferred embodiment of a second two receiver passage construction element 125 into a receiver track 21 of a first two receiver passage construction element 123, slidably mating an element key 41 of the second two receiver passage construction element 125 with a first track channel 23 and a second track channel 25 of a receiver track 21 of the first two receiver passage construction element 123, in an inserted configuration 127 as shown in FIG. 7.

It should be noted that the foregoing description in regard to the two receiver passage construction element 72, as shown in FIGS. 5-9, as well as the description presented below and shown in FIGS. 10-13, is representative and illustrative of preferred embodiments of construction elements 11 having two or more receiver passages 15. Referring further to FIG. 5, in regard to preferred embodiments of the construction elements 11 having any number of a plurality of body portions 131, such as the construction element shown in FIG. 33 for example, the body portion interior sides 133 of the contiguous body portions 131 may preferably be connected by two or more bridge elements 81, while the un-connected body portion side 135 of each body portion 131 may preferably have an element key 41.

Referring now to FIGS. 12-13, FIGS. 3-4, and FIG. 1, as stated above for preferred embodiments, the element key length 45 and the element key dimensioning 47, together with uniformity in the receiver track length 31 and channel track shape and dimension uniformity, will provide for the insertion of the element key 41 of a second construction element 53, which for the embodiment shown in FIG. 12 is a second two receiver passage construction element 125, in any of the receiver tracks 21 of the first construction element 51, which for the embodiment showing in FIG. 12, is a first two receiver passage construction element 123. The second construction element 53, 125 is shown in an element aligned position 124 and positioned for insertion in a receiver track 21 of a first construction element 51, 123 in an element rotated configuration 127 as shown in FIG. 13, the second receiver passage construction element 53, 125 having been rotated axially 58 about the two receiver passage longitudinal axis 119 prior to insertion into the construction element inserted configuration 127 in an element rotated configuration 127.

Referring now to FIG. 14, a slidable construction element 151 which may be included in the preferred embodiment of the construction toy set of the present invention, is shown in a slidable element inserted configuration 161 with a two receiver passage construction element 72. Referring also to FIG. 2, for preferred embodiments of the slidable construction element 151, the slidable element width 155 may match the receiver track length 31 of the respective receiver tracks 21 of the receiving construction element 163 as well as the other construction elements of the construction toy set. The slidable construction element 151 of preferred embodiments, may have a uniform slidable element width 155, regardless of the number of slidable receiver passages 169 and may have a slidable element edge shape 157 which matches the shape of the first track channel 23 and the second track channel 25 of the receiving construction element 163 as well as other construction elements 11 of the construction toy set, thereby providing for the slidable mating of the slidable construction elements 151 with the respective receiver tracks 21 of construction elements 11 of the construction toy set.

Referring now to FIG. 10 and FIG. 11 a multiple construction element assembly 173 of three two receiver passage construction elements 72, namely the first two receiver passage element 123, a second receiver passage element 125 and a third two receiver passage construction element 126 is shown which illustrates the flexibility and variability of the many construction element assemblies 173 that are provided by the construction toy set of the present invention, particularly for embodiments having uniformly dimensioned and shaped receiver passages 15, receiver tracks 21, and element keys 41.

Referring further to FIG. 10, the key peripheral surface 181 of an element key 41 of the second two receiver passage construction element 125 is abutted to and aligned with the key peripheral surface 182 of the element key 41 of the third two receiver passage construction element 126 in a key abutted configuration 171, and two element keys 41 of the first two receiver passage construction element 123 are aligned for insertion in respective receiver tracks 21 of the second two receiver passage construction element 125 and the third two receiver passage construction element 126, which insertion is shown in FIG. 11, wherein the first two receiver passage construction element 123, the second two receiver passage construction element 125, and the third two receiver passage construction element 126 are shown in one of the many variations of a construction element assembly 173 that is provided to the user by the present invention.

It will be obvious to persons of ordinary skill in the art, in view of FIGS. 10 and 11, the other figures, and this specification, that embodiments of the construction element 11 having any number of a plurality of receiver passages 15 with uniformly dimensioned and shaped receiver tracks 21 and uniformly dimensioned and shaped element keys 41 may be assembled together in a variety of configurations. Also, other embodiments having some variation in the dimensioning and shape of receiver tracks 21 and corresponding matching variation in the dimensioning and shape of element keys 41, may provide for more complex and mentally challenging assembly options for the user of the construction elements 11.

Referring again to FIG. 14, for preferred embodiments the slidable construction element receiver track 169 may have a slidable element track length 170 which is equal to the receiver track length 31 of typical construction elements, such as those shown in FIG. 1 and FIG. 5 for example, and may have a slidable element first track channel 195 and a slidable element second track channel 197 which match the shape and dimensions of the first receiver tracks 23 and the second receiver tracks 25 of the typical construction elements 11 such as those shown in FIG. 1, FIG. 2, and FIG. 5. This provides for the slidable element assembly 193 of the respective slidable constructive elements 151 as shown in FIG. 16. This also provides for a nested assembly 192 of a typical construction element 11, such as the two receiver construction element 72 shown in FIG. 15, with a slidable construction element 151 in a inserted configuration 191 as shown in FIG. 15. Referring again to FIG. 16, various types of interconnections between typical construction elements 11, namely the two receiver passage construction elements 72 shown in an inserted configuration 127 while each of the two slidable construction elements 151 are shown in a slidable element inserted configuration 161 and the two slidable construction elements 151 are shown interconnecting in a slidable element assembly 193.

It will be obvious for a person of ordinary skill in the art, in view of FIGS. 13-16 and this specification that there will be numerous interconnection and assembly options available for interconnection between respective construction elements 11, between construction elements 11 and slidable construction elements 151, and between respective slidable construction elements 151 for embodiments of the construction toy set of the present invention which include both construction elements 11 and slidable construction elements 151.

Preferred embodiments may provide for uniform dimensioning and uniform shape as described previously for the construction elements 11, and uniform dimensioning and uniform shape of the slidable construction elements 151, thereby providing for maximum compatibility, flexibility, and variability in the interconnections that can be achieved by the user in building, erecting and fabricating construction element assemblies 201 for which examples are shown in FIGS. 4, 7, 9, 11, 13, and 14-16. The benefits of uniformity and compatibility will be obvious to persons of ordinary skill in the art of in view of the drawings and this specification. However, alternative embodiments of the construction toy set of the present invention may be provided having construction elements 11 and slidable construction elements 151, with element bodies 13, receiver passages 15, receiver tracks 21, and element keys 41, with more than one set of shapes and dimensions. While such variations may result in the incompatibility and non-connectivity of some of the construction elements 11 and slidable construction elements 151, they may provide for some additional complexity and additional learning experience of users of the construction toy set of the present invention.

Referring now generally to FIG. 17-37, various accessory elements 209 are shown which may be included in the construction toy system unit of the present invention which may provide additional activity options and may promote additional interest and enjoyment for the user, as well as additional learning and educational opportunities. Referring to FIG. 17, socket element 211 may have an element key end dimension which may mate with the channel tracks of the typical construction unit 11 or typical slidable construction elements 151. This socket element 211 accessory may provide a ball receptacle for a ball 212 of a ball and rod element 213.

FIGS. 18 and 19 illustrate additional configurations for utilization of the socket element 211 and the ball and rod element 213.

Referring now to FIG. 20, a sleeve element 215 may interconnect with a snap element 217. Referring further to FIG. 21, two snap units 217 may be positioned in perpendicular receiver tracks 21 in a receiver passage 15.

Referring to FIG. 22, a pivot element 219 may pivotally interconnect with construction elements 11 and slidable construction elements 151 through the mating of the pivot studs 220 with track channels 23, 25 of channel tracks 21 of respective construction elements 11 or slidable construction elements 151.

Referring now to FIG. 23, ball joint element 221, may provide another connection option for a ball and rod element 213. Referring to FIG. 24, further options for the ball joint element 221 and the ball and rod element 213 are shown, with opposing ball joint elements 221 being installed in opposing sides of the same construction element 11 Each ball joint element 221 having a connected ball and rod element 213. Referring now to FIG. 25, an illustration of the use of ball joint elements 221, socket elements 211, and ball and rod elements 213, in conjunction with a pair of two receiver passage construction elements 72.

Referring now to FIGS. 26-30 various types of wheel elements 223, 225, 227, 229 are shown which may be connected to a construction element 11 as shown in FIGS. 26, 28 and 29, or to the slidable construction element 151 as shown in FIG. 30.

Referring now to FIG. 31 an irregular construction element 231 is shown which has four body portions 253, each of the body portions 253 having two element keys 41, with each of the element keys 41 having a key axis 243 with a key angular displacement 251 from a bridge axis 241 which is other than ninety degrees. For the embodiment shown, the key angular displacement 251 may be sixty degrees. Regardless of the key angular displacement 251, the irregular construction element 231 of FIG. 31 provides additional interconnection options for the construction toy set of the present invention.

Similarly the irregular construction element 231 of FIG. 32, which has two receiver passages 15, is shown engaged by a ball joint element 215.

FIG. 33 illustrates an accessory element 209 nested connection 261 of a lever arm 233.

FIG. 34 illustrates an accessory element 209 which is a multiple-unit lever arm 265.

FIG. 35 illustrates an accessory element 209 which is an irregular construction element 273 with three element keys 41.

FIG. 36 illustrates an accessory element 209 which is an irregular construction element 273 with extended element keys 277.

FIG. 37 illustrates an accessory element 209 which is an irregular construction element 273 with two perpendicular extended element keys 277 and one irregular element key 269.

In view of the drawings and the disclosures of this specification, it will be obvious to persons of ordinary skill in the art that the accessory elements 209 shown in the foregoing FIGS. 17-37 are merely illustrative, and additional variations and embodiments of accessory elements 209 for inclusion in the construction toy set of the present invention, in view of the drawings and the disclosures of this specification, will be obvious to persons of skill in the art.

The construction toy set of the present invention may incorporate single receiver passage elements 12; may incorporate construction elements 11 having a plurality of receiver passages 15; may incorporate slidable construction elements 151 having one or more slidable receiver passages 169; and may incorporate one or more accessory elements 209, including irregular construction elements 273. Various combinations of the construction elements 11 of the present invention may be incorporated in the construction toy set of the present invention, based on factors such as age of the user or cost.

In view of the disclosures of this specification and the drawings, other embodiments and other variations and modifications of the embodiments described above will be obvious to a person skilled in the art. Therefore, the foregoing is intended to be merely illustrative of the invention and the invention is limited only by the following claims and the doctrine of equivalents.

What is claimed is:

1. A construction toy set comprising a plurality of construction elements, each construction element having a generally wafer shaped element body with an element first surface, an element second surface, and a plurality of element lateral edges, the element body having one or more internal receiver passages extending through the element body from the element first surface to the element second surface, the one or more receiver passages having a respective plurality of receiver tracks extending laterally across the receiver passage from a respective first track channel in the passage interior peripheral surface to a respective second track channel in the passage interior peripheral surface, the receiver tracks having a respective track length, each track channel having a respective track channel dimensioning, each receiver track being angularly displaced in the receiver passage with respect to each of the other receiver tracks of the receiver passage, the element body having one or more element keys, each element key protruding laterally from a respective element key side of a respective element lateral edge, each element key having a respective key length and a respective key dimensioning, the respective key length and the respective key dimensioning of each key providing for a key insertion of an element key of a first construction element in a receiver track of a second construction element and for the key slidable mating of the element key with a first track channel and a second track channel of the receiver track of the second construction element, the key length and the key dimensioning of the element key of the first construction element matching the track length and the track channel dimensioning of the receiver track of the second construction element, the plurality of receiver tracks of the second construction element providing for the insertion of the element key of the first construction element in a selected one of a plurality of element rotated positions with respect to the second construction element.

2. The construction toy set recited in claim 1 wherein one or more receiver passages of one or more of the construction elements have four receiver tracks.

3. The construction toy set recited in claim 1, further comprising a slidable construction element, the slidable construction element having a uniform slidable element width matching the receiver track length of one or more of the receiver tracks of one or more of the construction elements and having slidable element edges with a uniform slidable element edge dimensioning which matches the channel dimensioning of the first track channel and the second track channel of the receiver track of the construction element, providing for a slidable element insertion of the slidable construction element in the receiver track of the construction element and for a slidable element slidable mating of the respective slidable element edges with the first track channel and the second track channel respectively of the receiver track.

4. The construction toy set recited in claim 3 wherein the slidable construction element has a slidable element receiver passage and a slidable element receiver track with a slidable element first track channel and a slidable element second track channel, the slidable element receiver track having a slidable element receiver track length which is the same as the track length of one or more receiver tracks of one or more of the construction elements, and the slidable element receiver track has a first slidable element receiver track channel and a second slidable element receiver track channel which have a slidable element track channel dimensioning matching the receiver track channel dimensioning of the construction element.

5. A construction toy set comprising a plurality of construction elements, each construction element having a generally wafer shaped element body with an element first surface, an element second surface, and a plurality of element lateral edges, the element body having one or more internal receiver passages extending through the element body from the element first surface to the element second surface, the one or more receiver passages having a respective passage central axis which is generally perpendicular to the element first surface and the element second surface, the one or more receiver passages having a respective plurality of receiver tracks extending laterally across the receiver passage from a respective first track channel in the passage interior peripheral surface to a respective second track channel in the passage interior peripheral surface, the receiver tracks having a common track length, each track channel having a common track channel dimensioning, each receiver track of each respective receiver passage having a respective track central axis which is aligned with the passage central axis of the respective receiver passage, each receiver track being angularly displaced in the receiver passage with respect to each of the other receiver tracks of the receiver passage, the element body having one or more element keys, each element key protruding laterally from a respective element key side of a respective element lateral edge, each element key having a common key length and a common key dimensioning, the key length and dimensioning providing for a key insertion of an element key of a first construction element in a receiver track of a second construction element and for a key slidable mating of the element key of the first construction element with a first track channel and a second track channel of the receiver track of the second construction element, the plurality of receiver tracks of the second construction element providing for the insertion of the element key of the first construction element in a selected one of a plurality of element rotated positions with respect to the second construction element.

6. The construction toy set recited in claim 5 wherein one or more receiver passages of one or more of the construction elements have four receiver tracks.

7. The construction toy set recited in claim 5, further comprising a slidable construction element, the slidable construction element having a uniform slidable element width matching the receiver track length of the receiver tracks of the construction element and having slidable element edges with a uniform slidable element edge dimensioning which matches the channel dimensioning of the first track channel and the second track channel of the receiver tracks of the construction element, providing for a slidable element insertion of the slidable construction element in any of the receiver tracks of the construction element and for a slidable element slidable mating of the respective slidable element edges with the first track channel and the second track channel respectively of the receiver track.

8. The construction toy set recited in claim 7 wherein the slidable construction element has a slidable element receiver passage and a slidable element receiver track with a slidable element first track channel and a slidable element second track channel, the slidable element receiver track having a slidable element receiver track length which is the same as the common track length of the construction element receiver tracks and the slidable element receiver track has a first slidable element receiver track channel and a second slidable element receiver track channel which have a slidable element track channel dimensioning matching the receiver track channel dimensioning of the construction element.

9. The construction toy set recited in claim 5 further comprising one or more irregular construction elements.

10. The construction toy set recited in claim 5 further comprising one or more accessory elements.

11. A construction toy set comprising a plurality of construction elements, each construction element having a generally wafer shaped element body with an element first surface, an element second surface, and a plurality of element lateral edges, the element body having one or more internal receiver passages extending through the element body from the element first surface to the element second surface, the one or more receiver passages having a respective passage central axis which is generally perpendicular to the element first surface and the element second surface, the one or more receiver passages having four receiver tracks extending laterally across the receiver passage from a respective first track channel in the passage interior peripheral surface to a respective second track channel in the passage interior peripheral surface, the receiver tracks having a common track length, each track channel having a common track channel dimensioning, each receiver track of each respective receiver passage having a respective track central axis which is aligned with the passage central axis of the respective receiver passage, the element body having one or more element keys, each receiver track being angularly displaced in the receiver passage with respect to each of the other receiver tracks of the receiver passage, each element key protruding laterally from a respective element key side of a respective element lateral edge, each element key having a common key length and a common key dimensioning, the key length and dimensioning providing for a key insertion of an element key of a first construction element in a receiver track of a second construction element and for a key slidable mating of the element key of the first construction element with a first track channel and a second track channel of the receiver track of the second construction element, the plurality of receiver tracks of the second construction element providing for the insertion of the element key of the first construction element in a selected one of a plurality of element rotated positions with respect to the second construction element.

12. The construction toy set recited in claim 11, further comprising a slidable construction element, the slidable construction element having a uniform slidable element width matching the receiver track length of the receiver tracks of the construction element and having slidable element edges with a uniform slidable element edge dimensioning which matches the channel dimensioning of the first track channel and the second track channel of the receiver tracks of the construction element, providing for a slidable element insertion of the slidable construction element in any of the receiver tracks of the construction element and for a slidable element slidable mating of the respective slidable element edges with the first track channel and the second track channel respectively of the receiver track.

13. The construction toy set recited in claim 12 wherein the slidable construction element has a slidable element receiver passage and a slidable element receiver track with a slidable element first track channel and a slidable element second track channel, the slidable element receiver track having a slidable element receiver track length which is the same as the common track length of the construction element receiver tracks and the slidable element receiver track has a first slidable element receiver track channel and a second slidable element receiver track channel which have a slidable element track channel dimensioning matching the receiver track channel dimensioning of the construction element.

14. The construction toy set recited in claim 11 further comprising one or more irregular construction elements.

15. The construction toy set recited in claim 11 further comprising one or more accessory elements.

16. A construction element for a construction toy set, the construction element having a generally wafer shaped element body with an element first surface, an element second surface, and a plurality of element lateral edges, the element body having one or more internal receiver passages extending through the element body from the element first surface to the element second surface, the one or more receiver passages having a respective plurality of receiver tracks extending laterally across the receiver passage from a respective first track channel in the passage interior peripheral surface to a respective second track channel in the passage interior peripheral surface, the receiver tracks having a respective track length, each track channel having a respective track channel dimensioning, each receiver track being angularly displaced in the receiver passage with respect to each of the other receiver tracks of the receiver passage, the element body having one or more element keys, each element key protruding laterally from a respective element key side of a respective element lateral edge, each element key having a respective key length and a respective key dimensioning, the respective key length and the respective key dimensioning of each key providing for a key insertion of the element key of a first construction element in a receiver track of a second construction element and for the key slidable mating of the element key with a first track channel and a second track channel of the receiver track of the second construction element, the key length and the key dimensioning of the first construction element matching the track length and the track channel dimensioning of one or more of the receiver tracks of the second construction element, the plurality of receiver tracks of the second construction element providing for the insertion of the element key of the first construction element in a selected one of a plurality of element rotated positions with respect to the second construction element.

17. The construction element recited in claim 16 wherein one or more receiver passages of the construction element have four receiver tracks.

18. A construction element for a construction toy set, the construction element having a generally wafer shaped element body with an element first surface, an element second surface, and a plurality of element lateral edges, the element body having one or more internal receiver passages extending through the element body from the element first surface to the element second surface, the one or more receiver passages having a respective passage central axis which is generally perpendicular to the element first surface and the element second surface, the one or more receiver passages having a respective plurality of receiver tracks extending laterally across the receiver passage from a respective first track channel in the passage interior peripheral surface to a respective second track channel in the passage interior peripheral surface, the receiver tracks having a common track length, each track channel having a common track channel dimensioning, each receiver track of each respective receiver passage having a respective track central axis which is aligned with the passage central axis of the respective receiver passage, each receiver track being angularly displaced in the receiver passage with respect to each of the other receiver tracks of the receiver passage, the element body having one or more element keys, each element key protruding laterally from a respective element key side of a respective element lateral edge, each element key having a key length and a key dimensioning which provide for a key insertion of an element key in a receiver track of a second construction element and for the key slidable mating of the element key with a first track channel and a second track channel of the receiver track of the second construction element, the plurality of receiver tracks of the second construction element providing for the insertion of the element key of the first construction element in a selected one of a plurality of element rotated positions with respect to the second construction element.

19. The construction element recited in claim 18 wherein one or more receiver passages of the construction element have four receiver tracks.

* * * * *